US006318537B1

(12) United States Patent
Jones et al.

(10) Patent No.: US 6,318,537 B1
(45) Date of Patent: Nov. 20, 2001

(54) CURRENCY PROCESSING MACHINE WITH MULTIPLE INTERNAL COIN RECEPTACLES

(75) Inventors: John E. Jones, Winnetka; William J. Jones, Barrington; Mark C. Munro, Park Ridge; Cherrie L. Brown, Lombard; George T. Seelenbinder, Elk Grove Village; Eric R. Carver, Palatine; John C. Peklo, Elmhurst, all of IL (US)

(73) Assignee: Cummins-Allison Corp., Mt. Prosptect, IL (US)

( * ) Notice: Subject to any disclaimer, the term of this patent is extended or adjusted under 35 U.S.C. 154(b) by 0 days.

(21) Appl. No.: 09/562,231

(22) Filed: Apr. 28, 2000

Related U.S. Application Data

(60) Provisional application No. 60/131,635, filed on Apr. 28, 1999.

(51) Int. Cl.[7] ..... G07F 1/04; G07D 3/00
(52) U.S. Cl. ..... 194/346; 453/10
(58) Field of Search ..... 194/346; 453/3, 453/4, 6, 10, 31

(56) References Cited

U.S. PATENT DOCUMENTS

| | | | |
|---|---|---|---|
| D. 285,095 | 8/1986 | Lundgren et al. | D18/3 D |
| D. 369,984 | 5/1996 | Larsen | D10/97 |
| D. 422,016 | 3/2000 | Forslund | D18/3 |
| 2,669,998 | 2/1954 | Buchholz | 133/8 |
| 2,750,949 | 6/1956 | Kulo et al. | 133/8 |

(List continued on next page.)

FOREIGN PATENT DOCUMENTS

| | | | |
|---|---|---|---|
| 660354 | 5/1938 | (DE) . | |
| 2528735 | 8/1976 | (DE) | B60K/17/10 |
| 3021327A1 | 12/1981 | (DE) | G07D/3/06 |
| A0077464 | 4/1983 | (EP) . | |
| 010115 A1 | 1/1984 | (EP) . | |

(List continued on next page.)

OTHER PUBLICATIONS

"CDS Automated Receipt Giving Cash Deposit System," Case–ICC Limited, 3 pages.
"Scan Coin Technical Referens Manual," Scan Coin AB, 1989, 7 pages.
"Scan Coin Cash Deposit System," Scan Coin GmbH, 03/90, 6 pages.
"Scan Coin News," 05/91, 2 pages.
"Scan Coin Technical Referens Manual," Scan Coin AB, 1989, pp. 3–93 odd pages only.
"Scan Coin World," 02/88, 2 pages.
"Technical Manual, Cash Deposit System Model CDS 600 & CDS 640," Scan Coin AB, 1991, 44 pages.
"Munzgbeldeinzhlungen in Selbstbedienung: Cash Deponier System CD 500," 6 pages.
"Technical Specificatio ns GBS9401 SB," Fa GBS–Geldbearbeitungssysteme, 24 pages.

(List continued on next page.)
With Richard Haycock; pp. 1–5; dated; estimated 1994.

*Primary Examiner*—Richard Chilcot
*Assistant Examiner*—Bryan Jaketic
(74) *Attorney, Agent, or Firm*—Jenkens & Gilchrist

(57) ABSTRACT

A currency processing machine in which a user deposits funds including coins of mixed denominations and paper notes is provided. The currency processing machine comprises means for receiving and counting the paper notes, a hopper for receiving the coins of mixed denominations, and means for determining the amount of the deposited funds. A sorting device sorts the mixed coins into denominations. A coin receptacle station for each denomination receives the sorted coins. Each of the coin receptacle stations includes a plurality of coin receptacles for holding the sorted coins and a coin distribution mechanism for selectively distributing the sorted coins between the plurality of coin receptacles.

120 Claims, 25 Drawing Sheets

U.S. PATENT DOCUMENTS

| | | | |
|---|---|---|---|
| 2,835,260 | 5/1958 | Buchholz | 133/8 |
| 2,865,561 | 12/1958 | Rosapepe | 232/7 |
| 3,132,654 | 5/1964 | Adams | 133/1 |
| 3,173,742 | 3/1965 | Simjian | 346/22 |
| 3,246,295 | 4/1966 | Claris et al. | 382/56 |
| 3,280,974 | 10/1966 | Riddle et al. | 209/111.8 |
| 3,480,785 | 11/1969 | Aufderheider | 250/219 |
| 3,496,370 | 2/1970 | Havill et al. | 356/71 |
| 3,509,535 | 4/1970 | Berube | 340/149 |
| 3,612,835 | 10/1971 | Andrews et al. | 235/61.11 D |
| 3,618,765 | 11/1971 | Syosset et al. | 209/122 |
| 3,679,314 | 7/1972 | Mustert | 250/556 |
| 3,715,031 | 2/1973 | Okkomen | 209/75 |
| 3,764,899 | 10/1973 | Peterson et al. | 324/61 R |
| 3,778,628 | 12/1973 | Novak et al. | 250/556 |
| 3,800,078 | 3/1974 | Cochran et al. | 178/7.1 |
| 3,806,710 | 4/1974 | Shigemori et al. | 235/92 |
| 3,815,021 | 6/1974 | Kerr | 324/61 R |
| 3,842,281 | 10/1974 | Goodrich | 250/461 |
| 3,870,629 | 3/1975 | Carter et al. | 209/111.8 |
| 3,906,449 | 9/1975 | Marchak | 340/149 R |
| 3,976,198 | 8/1976 | Carnes et al. | 209/11.7 T |
| 4,041,456 | 8/1977 | Ott et al. | 340/146.3 R |
| 4,059,122 | 11/1977 | Kinoshita | 133/3 |
| 4,096,991 | 6/1978 | Iguchi | 235/419 |
| 4,114,804 | 9/1978 | Jones et al. | 235/476 |
| 4,147,430 | 4/1979 | Gorgone et al. | 356/51 |
| 4,150,740 | 4/1979 | Douno | 194/4 |
| 4,172,462 | 10/1979 | Uchida et al. | 133/3 |
| 4,179,685 | 12/1979 | O'Maley | 340/146.3 H |
| 4,205,780 | 6/1980 | Burns et al. | 235/454 |
| 4,249,552 | 2/1981 | Margolin et al. | 133/1 |
| 4,250,806 | 2/1981 | Boyson et al. | 101/2 |
| 4,255,651 | 3/1981 | Phillips | 235/92 |
| 4,264,808 | 4/1981 | Owens et al. | 235/379 |
| 4,266,121 | 5/1981 | Hirose | 235/381 |
| 4,277,774 | 7/1981 | Fujii et al. | 340/146.3 |
| 4,283,708 | 8/1981 | Lee | 340/146.3 Z |
| 4,288,781 | 9/1981 | Sellner et al. | 340/146.3 Q |
| 4,302,781 | 11/1981 | Ikeda et al. | 358/486 |
| 4,310,885 | 1/1982 | Azcua et al. | 364/405 |
| 4,311,914 | 1/1982 | Huber | 250/556 |
| 4,313,598 | 2/1982 | DiBlasio | 271/124 |
| 4,321,672 | 3/1982 | Braun et al. | 364/40 |
| 4,334,619 | 6/1982 | Horino et al. | 209/551 |
| 4,337,864 | 7/1982 | McLean | 209/534 |
| 4,348,656 | 9/1982 | Gorgone et al. | 340/146.3 R |
| 4,349,111 | 9/1982 | Shah et al. | 209/534 |
| 4,352,988 | 10/1982 | Ishida | 250/559 |
| 4,355,300 | 10/1982 | Weber | 340/146.3 C |
| 4,355,369 | 10/1982 | Garvin | 364/900 |
| 4,356,473 | 10/1982 | Freudenthal | 340/146.3 H |
| 4,360,034 | 11/1982 | Davila et al. | 133/3 |
| 4,380,316 | 4/1983 | Glinka et al. | 232/16 |
| 4,381,447 | 4/1983 | Horvath et al. | 250/223 |
| 4,386,432 | 5/1983 | Nakamura et al. | 382/7 |
| 4,396,902 | 8/1983 | Warthan et al. | 382/64 |
| 4,416,299 | 11/1983 | Bergman | 133/1 R |
| 4,434,359 | 2/1984 | Watanabe | 235/379 |
| 4,442,541 | 4/1984 | Finkel et al. | 382/7 |
| 4,461,028 | 7/1984 | Okubo | 382/15 |
| 4,464,786 | 8/1984 | Nishito et al. | 382/7 |
| 4,464,787 | 8/1984 | Fish et al. | 382/7 |
| 4,480,177 | 10/1984 | Allen | 235/379 |
| 4,487,306 | 12/1984 | Nao et al. | 194/4 |
| 4,490,846 | 12/1984 | Ishida et al. | 382/7 |
| 4,513,439 | 4/1985 | Gorgone et al. | 382/7 |
| 4,530,067 | 7/1985 | Dorr | 364/900 |
| 4,538,719 | 9/1985 | Gray et al. | 194/100 A |
| 4,539,702 | 9/1985 | Oka | 382/7 |
| 4,542,829 | 9/1985 | Emery et al. | 209/534 |
| 4,543,969 | 10/1985 | Rasmussen | 133/3 |
| 4,544,266 | 10/1985 | Antes | 356/71 |
| 4,547,896 | 10/1985 | Ohtombe et al. | 382/7 |
| 4,553,222 | 11/1985 | Kurland et al. | 364/900 |
| 4,553,846 | 11/1985 | Hilton et al. | 356/429 |
| 4,556,140 | 12/1985 | Okada | 194/4 |
| 4,558,224 | 12/1985 | Gober | 250/460.1 |
| 4,558,711 | 12/1985 | Yoshiaki et al. | 133/3 |
| 4,559,451 | 12/1985 | Curl | 250/560 |
| 4,563,771 | 1/1986 | Gorgone et al. | 382/7 |
| 4,567,370 | 1/1986 | Falls | 250/461.1 |
| 4,569,421 | 2/1986 | Sandstedt | 186/39 |
| 4,582,172 | 4/1986 | Takeuchi et al. | 186/38 |
| 4,587,412 | 5/1986 | Apisdorf | 235/449 |
| 4,587,434 | 5/1986 | Roes et al. | 250/556 |
| 4,592,090 | 5/1986 | Curl et al. | 382/7 |
| 4,593,184 | 6/1986 | Bryce | 235/449 |
| 4,594,664 | 6/1986 | Hashimoto | 364/405 |
| 4,611,205 | 9/1986 | Eglise | 340/825 |
| 4,611,345 | 9/1986 | Ohnishi et al. | 382/7 |
| 4,617,458 | 10/1986 | Bryce | 235/449 |
| 4,622,456 | 11/1986 | Naruto et al. | 235/379 |
| 4,628,194 | 12/1986 | Dobbins et al. | 235/379 |
| 4,645,936 | 2/1987 | Gorgone | 220/556 |
| 4,653,647 | 3/1987 | Hashimoto | 209/534 |
| 4,658,289 | 4/1987 | Nagano et al. | 358/75 |
| 4,676,343 | 6/1987 | Humble et al. | 186/61 |
| 4,677,682 | 6/1987 | Miyagawa et al. | 382/7 |
| 4,678,072 | 7/1987 | Kobayashi et al. | 194/206 |
| 4,697,071 | 9/1987 | Hiraoka et al. | 235/379 |
| 4,700,368 | 10/1987 | Munn et al. | 377/8 |
| 4,706,577 | 11/1987 | Jones | 109/59 |
| 4,716,456 | 12/1987 | Hosaka | 358/75 |
| 4,733,308 | 3/1988 | Nakamura et al. | 358/496 |
| 4,735,289 | 4/1988 | Kenyon | 186/37 |
| 4,743,974 | 5/1988 | Lockwood | 358/285 |
| 4,748,679 | 5/1988 | Gold et al. | 382/61 |
| 4,753,625 | 6/1988 | Okada | 453/32 |
| 4,764,976 | 8/1988 | Kallin et al. | 382/65 |
| 4,782,328 | 11/1988 | Denlinger | 340/365 |
| 4,804,830 | 2/1989 | Miyagisima et al. | 235/379 |
| 4,806,709 | 2/1989 | Evans | 178/19 |
| 4,811,004 | 3/1989 | Person et al. | 340/712 |
| 4,821,332 | 4/1989 | Durham | 382/7 |
| 4,823,393 | 4/1989 | Kawakami | 382/7 |
| 4,825,246 | 4/1989 | Fukuchi et al. | 355/4 |
| 4,827,531 | 5/1989 | Milford | 382/7 |
| 4,837,842 | 6/1989 | Holt | 382/26 |
| 4,841,358 | 6/1989 | Kammoto et al. | 358/75 |
| 4,851,616 | 7/1989 | Wales et al. | 178/18 |
| 4,877,230 | 10/1989 | Winkler et al. | 271/3 |
| 4,880,096 | 11/1989 | Kobayaski et al. | 194/206 |
| 4,881,268 | 11/1989 | Uchida et al. | 382/7 |
| 4,883,158 | 11/1989 | Kobayashi et al. | 194/217 |
| 4,883,181 | 11/1989 | Yoshikawa | 209/534 |
| 4,888,812 | 12/1989 | Dinan et al. | 382/7 |
| 4,903,953 | 2/1990 | Winkler et al. | 271/4 |
| 4,905,840 | 3/1990 | Yuge et al. . | |
| 4,908,516 | 3/1990 | West | 250/556 |
| 4,921,463 | 5/1990 | Primdahl et al. | 453/3 |
| 4,922,109 | 5/1990 | Bercovitz et al. | 194/207 |
| 4,928,094 | 5/1990 | Smith | 340/712 |
| 4,931,782 | 6/1990 | Jackson | 340/706 |
| 4,953,086 | 8/1990 | Fukatsu | 364/408 |
| 4,954,697 | 9/1990 | Kokubun et al. | 235/381 |
| 4,970,655 | 11/1990 | Winn et al. | 364/479 |
| 4,973,851 | 11/1990 | Lee | 250/556 |
| 4,980,543 | 12/1990 | Hara et al. | 209/534 |
| 4,992,860 | 2/1991 | Hamaguchi et al. | 358/75 |
| 4,996,604 | 2/1991 | Ogawa et al. | 358/486 |

| | | | |
|---|---|---|---|
| 5,023,782 | 6/1991 | Lutz et al. | 364/405 |
| 5,027,415 | 6/1991 | Hara et al. | 382/7 |
| 5,039,848 | 8/1991 | Stoken | 235/381 |
| 5,047,871 | 9/1991 | Meyer et al. | 358/486 |
| 5,054,621 | 10/1991 | Murphy et al. | 209/534 |
| 5,055,834 | 10/1991 | Chiba | 340/825 |
| 5,063,599 | 11/1991 | Concannon et al. | 382/7 |
| 5,068,519 | 11/1991 | Bryce . | |
| 5,091,961 | 2/1992 | Baus, Jr. | 382/7 |
| 5,105,601 | 4/1992 | Horiguchi et al. | 53/465 |
| 5,114,381 | 5/1992 | Ueda et al. | 453/57 |
| 5,122,754 | 6/1992 | Gotaas | 324/676 |
| 5,134,663 | 7/1992 | Kozlowski | 382/7 |
| 5,135,115 | 8/1992 | Miller et al. | 209/564 |
| 5,146,512 | 9/1992 | Weideman et al. | 382/30 |
| 5,151,607 | 9/1992 | Crane | 250/556 |
| 5,159,548 | 10/1992 | Caslavka | 364/408 |
| 5,163,672 | 11/1992 | Mennie | 271/187 |
| 5,163,868 | 11/1992 | Adams et al. | 453/11 |
| 5,167,313 | 12/1992 | Dobbins et al. | 194/317 |
| 5,183,142 | 2/1993 | Latchinian et al. | 194/206 |
| 5,184,115 | 2/1993 | Black et al. | 340/708 |
| 5,184,709 | 2/1993 | Nishiumi et al. | 194/318 |
| 5,186,334 | 2/1993 | Fukudome et al. | 209/534 |
| 5,187,750 | 2/1993 | Behera | 382/7 |
| 5,193,121 | 3/1993 | Elischer et al. | 382/7 |
| 5,198,976 | 3/1993 | Form et al. | 364/410 |
| 5,199,543 | 4/1993 | Kamagami et al. | 194/207 |
| 5,201,395 | 4/1993 | Takizawa et al. | 194/206 |
| 5,207,788 | 5/1993 | Geib et al. | 271/122 |
| 5,231,381 | 7/1993 | Duwaer | 340/712 |
| 5,237,158 | 8/1993 | Kern et al. | 235/379 |
| 5,239,593 | 8/1993 | Wittner et al. | 382/14 |
| 5,261,518 | 11/1993 | Bryce | 194/206 |
| 5,286,954 | 2/1994 | Sato et al. | 235/379 |
| 5,295,196 | 3/1994 | Raterman et al. | 382/135 |
| 5,297,030 | 3/1994 | Vassigh et al. | 364/405 |
| 5,299,977 | 4/1994 | Mazur et al. | 453/10 |
| 5,304,813 | 4/1994 | DeMan | 250/556 |
| 5,309,515 | 5/1994 | Troung et al. | 382/7 |
| 5,317,140 | 5/1994 | Dunthorn | 250/221 |
| 5,321,238 | 6/1994 | Kamata et al. | 235/379 |
| 5,335,292 | 8/1994 | Lovelady et al. | 382/17 |
| 5,341,408 | 8/1994 | Melcher et al. | 377/8 |
| 5,342,165 | 8/1994 | Graef et al. | 414/788.9 |
| 5,363,949 | 11/1994 | Matsubayashi | 194/206 |
| 5,367,577 | 11/1994 | Gotaas | 382/7 |
| 5,371,345 | 12/1994 | LeStrange et al. | 235/380 |
| 5,371,798 | 12/1994 | McWhortor | 380/51 |
| 5,379,344 | 1/1995 | Larsson et al. | 380/23 |
| 5,381,019 | 1/1995 | Sato | 250/556 |
| 5,430,664 | 7/1995 | Cargill et al. | 364/550 |
| 5,437,357 | 8/1995 | Ota et al. | 194/206 |
| 5,438,184 | 8/1995 | Roberts et al. | 235/380 |
| 5,444,793 | 8/1995 | Kelland | 382/138 |
| 5,459,304 | 10/1995 | Eisenmann | 235/380 |
| 5,465,301 | 11/1995 | Jotcham et al. | 380/54 |
| 5,465,821 | 11/1995 | Akioka | 194/207 |
| 5,467,405 | 11/1995 | Raterman et al. | 382/135 |
| 5,467,406 | 11/1995 | Graves et al. | 382/135 |
| 5,507,379 | 4/1996 | Mazur et al. | 194/318 |
| 5,530,772 | 6/1996 | Storey | 382/135 |
| 5,537,486 | 7/1996 | Stratigos et al. | 382/137 |
| 5,544,043 | 8/1996 | Miki et al. | 364/406 |
| 5,564,546 | 10/1996 | Molbak et al. | 194/216 |
| 5,592,377 | 1/1997 | Lipkin | 395/242 |
| 5,600,732 | 2/1997 | Ott et al. | 382/112 |
| 5,602,933 | 2/1997 | Blackwell et al. | 382/116 |
| 5,602,936 | 2/1997 | Green et al. | 382/140 |
| 5,607,040 | 3/1997 | Mathurin, Sr. | 194/207 |
| 5,620,079 | 4/1997 | Molbak | 194/217 |
| 5,633,949 | 5/1997 | Graves et al. | 382/135 |
| 5,640,463 | 6/1997 | Csulits | 382/135 |
| 5,652,802 | 7/1997 | Graves et al. | 382/135 |
| 5,746,299 | 5/1998 | Mobak et al. | 194/200 |
| 5,799,767 | 9/1998 | Molbak | 194/217 |
| 5,842,916 | 12/1998 | Gerrity et al. | 453/57 |
| 5,905,810 | 5/1999 | Jones et al. | 382/135 |
| 5,909,793 | 6/1999 | Beach et al. | 194/210 |
| 5,909,794 | 6/1999 | Molbak et al. | 194/216 |
| 5,957,262 | 9/1999 | Molbak et al. | 194/200 |
| 5,982,918 | 11/1999 | Mennie et al. | 382/135 |
| 5,988,348 | 11/1999 | Martin et al. | 194/317 |
| 6,017,270 | 1/2000 | Ristvedt et al. | 453/5 |
| 6,021,883 | 2/2000 | Casanova et al. | 194/217 |
| 6,047,807 | 4/2000 | Molbak | 194/217 |
| 6,047,808 | 4/2000 | Neubarth et al. | 194/317 |
| 6,056,104 | 5/2000 | Neubarth et al. | 194/317 |
| 6,080,056 | 6/2000 | Karlsson | 453/3 |
| 6,082,519 | 7/2000 | Martin et al. | 194/350 |
| 6,086,471 | 7/2000 | Zimmermann | 453/3 |
| 6,095,313 | 8/2000 | Molbak et al. | 194/344 |
| 6,116,402 | 9/2000 | Beach et al. | 194/216 |
| 6,128,402 | 10/2000 | Jones et al. | 382/135 |

FOREIGN PATENT DOCUMENTS

| | | | |
|---|---|---|---|
| 101115 | 2/1984 | (EP) . | |
| 0109743 | 5/1984 | (EP) . | |
| 0185200A2 | 6/1986 | (EP) . | |
| 0325364 | 7/1989 | (EP) . | |
| A0338123 | 10/1989 | (EP) . | |
| A0342642 | 11/1989 | (EP) . | |
| 0 583 526 A1 | 8/1992 | (EP) . | |
| 0 583 723 A1 | 8/1993 | (EP) . | |
| 0578875 | 1/1994 | (EP) . | |
| 0633553A1 | 1/1995 | (EP) . | |
| 0667973 B1 | 11/1993 | (EP) | G07D/3/14 |
| 0926634 A2 | 12/1998 | (EP) | G07D/3/14 |
| 0351217 A2 | 7/1989 | (EP) | G07F/9/04 |
| 70.11438 | 1/1971 | (FR) | G07B/11/00 |
| 2190996A | 12/1987 | (GB) . | |
| 2204166A | 11/1988 | (GB) . | |
| 2272762A | 5/1994 | (GB) . | |
| 2198274A | 6/1988 | (GB) | G07D/3/00 |
| 2175427 A | 11/1986 | (GB) | G07F/17/42 |
| 2223872A | 4/1990 | (GB) | G07F/9/08 |
| 3-63795 | 3/1991 | (JP) | G07D/3/00 |
| 1-307891 | 12/1989 | (JP) | G07D/9/00 |
| 3-92994 | 4/1991 | (JP) | G07D/9/00 |
| 44244 | 9/1988 | (SE) . | |
| WO85/00909 | 2/1985 | (WO) . | |
| 0 253 935 A2 | 1/1988 | (WO) . | |
| WO90/07165 | 6/1990 | (WO) . | |
| WO91/11778 | 8/1991 | (WO) . | |
| WO92/17394 | 10/1992 | (WO) . | |
| WO93/23824 | 11/1993 | (WO) . | |
| WO94/16412 | 7/1994 | (WO) . | |
| WO94/19773 | 9/1994 | (WO) . | |
| WO95/24691 | 3/1995 | (WO) . | |
| WO96/10800 | 9/1995 | (WO) . | |
| WO98/24041A1 | 6/1998 | (WO) . | |
| WO98/48383A2 | 10/1998 | (WO) . | |
| WO98/48384A2 | 10/1998 | (WO) . | |
| WO98/48385A2 | 10/1998 | (WO) . | |
| WO98/51082A1 | 11/1998 | (WO) . | |
| WO 99/00776 | 1/1999 | (WO) . | |
| WO 99/33030 | 7/1999 | (WO) | G07D/3/00 |

OTHER PUBLICATIONS

"Kundenselbstbedienung," 12 pages.
"Scan Coin Money Processing Systems," Scan Coin, 8 pages.
"Royal Bank Opens 'Super Branch,'" Murry Oxby, The Gazette Montreal, Sep. 14, 1991, article, 1 page.
"High–Tech Bank Counts Coins," Carolyn Leitch, Sep. 18, 1991, article,1 page.
"Royal's Burlington Drive–in Bank Provides Customers 24–Hour Tellers," Jade Hemeon, Toronto Star, Aug. 21, 1991, article, 1 page.
"Bank Blends New Technology With Service," Martin Cash, Sep. 4, 1992, article, 1 page.
"Scan Coin International Report," Scan Coin, 4/87–92, 49 pages.
Royal Bank Brochure, 2 pages.
"Scan Coin, Technical Manual, CDS MK 1 Coin Deposit System," Scan Coin AB, 1991, pp. 1–30.
"User's Manual Scan Coin CDS 600," Scan Coin, 23 pages.
"Scan Coin Service Information—Technical Manual SC 102 Value Counter," Scan Coin AB, 29 pages.
"Scan Coin CDS 640 Cash Deposit System," Scan Coin, Inc. 2 pages.
Mosler Inc. brochure "The Mosler/Toshiba CF–420", 1989.
AFB Currency Recognition System, 1982.
JetScan Currency Scanner/Counter, Model 4060, Operator's Manual by Cummins–Allison (8/91).
Sale of JetScan Currency Scanner/Counter, Model 4060 (8/91).
JetScan Currency Scanner/Counter, Model 4061, Operating Instructions by Cummins–Allison (Apr. 20, 1993).
Sale of JetScan Currency Scanner/Counter, Model 4061 (Apr. 20, 1993).
JetScan Currency Scanner/Counter, Model 4062, Operating Instructions by Cummins–Allison (Nov. 28, 1994).
Sale of JetScan Currency Scanner/Counter, Model 4062 (Nov. 28, 1994).
Brochure: Cash Deponier Systeme CDS 5700 und CDS 5800; date Jan. 3, 1995.
Brochure for NGZ 2100; date: prior to May 13, 1996.
Brochure for Contomat; date prior to May 13, 1996.
Brochure: PREMA 405 (RE) Self Service Coin Deposit Facility; date prior to May 13, 1996.
Brochure: Scan Coin CDS 600 Cash Deposit System; date Jun. 15, 1994.
Brochure: Scan Coin CDS 640 Cash Deposit System; Jun. 15, 1994.
Brochure: Cash Receipt System CRS/6501/CRS6510; IREIS; date Feb. 1995.
Cassius Elston, "No More Lines . . . Self Serve Cash–Out"; DropStream Developments; pp. 3–4; date prior to May 13, 1996.
Brochure for ISH I2005/500 SB–Münzähler; date prior to May 13, 1996 with translation.
Brochure for ISH I2005/501 SB–Münzähaler; date prior to May 13, 1996 with translation.
Brochure: The New CRS–8000 Cash Redemption System; Glory Cash Handling Systems; date: prior to May 13, 1996.
Brochure (2 pages) for Mach 7 High–Speed Coin Sorter/Counter, Brandt; dated Apr. 1, 1993.
Brochure (2 pages) for Model 8904 Upfeed, High Speed 4–Denomination Currency Dispenser; Brandt; dated prior to May 1996.
Operating Instructions (11 pages) for JetSort® High Speed Sorter/Counter (Kits I & J); Cummins–Allison Corp., dated 1993.
"Toshiba Fitness Sorter CF–400 Series", estimated 1989 or earlier, 6 pages.
Brochure for NGZ, Technical Information, Haft MBH Co. Vertriebs KG (2 pp.) (date unknown).
Brochure: Cashflow Emerald, Ascomb Autelca AG (2 pp.) (3/95).
Toshiba–Mosler Operator's Manual for CF–420 Cash Settlement System; pp. 1 to C–3. copyr. 1989.
Description of Toshiba–Mosler CF–420 Device; estimated 1989.
Currency Systems International, Medium Speed Currency Sorting Family, CPS 600 and CPS 900; 4 pages, date: copyr. 1994.
Glory GSA–500 Sortmaster brochure; 2 pages; date: Jan. 14, 1994.
Glory UF–1D brochure; 2 pages; date: estimated before Aug. 9, 1994.
Glory GFB–200/210/220/230, Desk–Top Bank Note Counter; date: estimated before Aug. 9, 1994.
Revised Drawings of portions of Mosler CF–420 Cash Management System (FIGs. A–C) and description of the same (1989).
Vector Video Tape.
Brochure: Provide Self–Service Solutions for Your Business Customers; Commercial Kiosk; 4 pages.
Brochure: JetSort High Speed Coin Sorter/Counter 2000 Series; Cummins; 2 pages.
Brochure: SR–700 Cash Settlement System; Glory; 4 pages.
Brochure: State–Of–The–Art Coin Procesing Comes of Age. JetSort Item No. 50–152; Cummins; 3 pages.
Brochure: 95 Series Coin Sorter/Counter; Brandt; 2 pages.
Brochure: JetSort High Speed Coin Sorters 3000 Series; Cummins; 2 pages.
CA–750 Jetsort Coin Processor; Item No. 50–152; Cummins; 1 page.
Model 920/925; Brandt; 2 pages.
Brochure: Model 958 Coin Sorter/Counter; Brandt; 5 pages.
Brochure: Model 960 High Speed Coin Sorter & Counter; Brandt; 2 pages.
Brochure: Model 966 Microsort Coin Sorter and Counter; Brandt; 4 pages.
Brochure: Model 970 Coin Sorter & Counter; Brandt; 2 pages.
Brochure: Model 954 Coin Sorter/Counter; Brandt; 2 pages.
Brochure; Model 957 Coin Sorter/Counter; Brandt; 2 pages.
Brochure: The Brandt 945 . . . a High Speed Sorting; 2 pages.
Brochure: Model 952 Coin Sorter/Counter; Brandt; 2 pages.
Brochure: Model 940–6 High Speed Sorter/Counter; Brandt; 2 pages.
Brochure: Model 1400 Coin Sorter/Counter; Brandt; 2 pages.
Advertisement: Solving Problems, Pleasing Customers, Building Deposits: Brandt System 930 Electric Counter/Sorter and Brandt Model 755 Security Stand; 1 page.
Brochure: Model 1205 Coin Sorter/Counter; Brandt; 2 pages.
Brochure: AI–1500 "Pulsar", Amiel Industries; 13 pages.
Brochure & Letter: Childers Magnum High Speed Coin Sorter; 3 pages.

Brochure: AMT Automated Merchant Teller; Glory; 4 pages.
Brochure: Hamilton's Express Banking Center; 4 pages.
Brochure: NamSys Express; NamSys Inc.; 2 pages.
Advertisement: "The New Standard–Class Coin Depsit Systems" CRS 6520 and CRS 6525; Reis Eurosystems; 1 page.
Advertisement; CS 3510–Disc–Sorter High–Capacity, High–Speed Coin Sorter; Reis Eurosystems; 1 page.
Advertisement: CDS602 Cash Deposit System; CTcoin; 1 page.
Brochure: ProCash CS; Siems Nixdorf; 4 pages.
"The Cash Room is History" ATS Money Systems; 4 pages.
"The new idean from ASCOM for self service zones: cashflow Emerald" ASCOm in banking; 2 pages.
Brochure: Model 817 Automated Coin and Currency Ordering System; Brandt; 2 pages.

"Merchant MicroBranch Combines ATM, After Hour Depository, Rolled–Coin Dispensor," Bank Technology News; 10/97 or 11/97; 1 page.

"Cash information & Settlement Systems," Cummins–Allison Corp.; 4 pages.

Barton, Louis L., "Check Processing Operations," Chapter 8 and Appendix 2, 1994, pp. 119–140 and 225–231.

Currency System Int'l, Mr. W. Kranister in Conversation

CURRENCY PROCESSING MACHINE WITH MULTIPLE INTERNAL COIN RECEPTACLES

CROSS-REFERENCE TO RELATED APPLICATION

This application claims priority to U.S. Provisional Application Ser. No. 60/131,635 filed Apr. 28, 1999.

FIELD OF THE INVENTION

The present invention relates generally to currency processing machines, and, in particular, to a currency processing machine which accepts bulk coins and selectively distributes the coins into one of a plurality of coin receptacles.

BACKGROUND OF THE INVENTION

Currency processing machines generally have the ability to receive bulk coin and/or bank notes from a user of the machine. The currency processing machine may be a redemption type of machine wherein, after the deposited coins and/or bank notes are counted, funds are returned to the user in a pre-selected manner determined by the user, or to a card which stores electronic money, such as a smartcard. Alternatively, the machine may be a simple deposit type of machine where funds which have been deposited by the user are credited to his or her account.

In these currency processing machines, the bulk coins that are received from users are typically sorted into individual denominations and deposited into containers corresponding to each respective denomination as sorted. When these containers have reached their capacity, the operator of the currency processing machine must then physically remove the full container and replace it with an empty container so that the machine can be returned to its operational state. However, in many environments, the coins deposited by the user into the currency processing machine are removed from the currency processing machine and recirculated into other types of coin discharging machines.

For example, in casinos, gaming machines must be filled by a bag commonly referred to as a "hopper fill bag" which contains a known amount of tokens/coins so that the gaming machine can discharge payouts to users who have won a jackpot. In some existing currency processing machines, the tokens/coins are held in a coin container and subsequently discharged from the machine through an exterior spout. When the machine is full of tokens/coins or when a gaming machine requires a fill of tokens/coins, a casino employee (e.g. the machine operator) manually places a hopper fill bag over the exterior spout and instructs the machine to fill it. The casino employee then transports the hopper fill bag to a gaming machine requiring additional tokens/coins.

One disadvantage associated with prior art currency processing machines is the large amount of time required for an operator (e.g. a casino employee) to unload the processed coins from the machine. Such a large amount is required because some machines utilize a single convey track to move coins from internal coin containers to an exterior spout to dispense the coins to the operator. An associated disadvantage, is that many of these prior art machines are unable to transact with a user while the operator is unloading the processed coins from the currency processing machines.

SUMMARY OF THE INVENTION

The present invention is a currency processing machine in which the user deposits coins of mixed denominations and also possibly bank notes. As used herein, the term "coins" includes U.S. and foreign coins and also tokens which have a monetary value, such as casino tokens. The user deposits the coins of mixed denominations into a hopper located at the front of the machine which is accessible to the user. The coins are then sorted by a sorting device into their respective denominations. The sorting device also counts the coins and may discriminate between authentic and non-authentic coins.

After determining the amount of the deposited coins, the currency processing machine typically provides a way for the user to convert the deposited coins into alternative funds available to the user. For example, the deposited amount of coins may be converted into bank notes. Or, the user may insert a card having media for storing a monetary amount, such as a smartcard, and the currency processing system places a credit on the inserted card. Further, the currency processing machine may convert the deposited amount as a credit to the user's specific account which is accessible by the currency processing machine. The currency processing machine may also have the capability of receiving and counting bank notes and provide for the same types of conversion of bank notes as described with respect to the depositing of coins.

The sorted coins are then sent from the sorting device to a coin receptacle station for each denomination. Each coin receptacle station includes a plurality of coin receptacles for holding the sorted coins of a specific denomination. The coin receptacle station may also include a coin distribution mechanism which selectively distributes the coins for each denomination between the plurality of coin receptacles. The coin distribution mechanism may be one of a variety of configurations such as one which moves a coin distributor tube between adjacent coin receptacles, one which employs a series of diverter mechanisms which divert coins to specific coin receptacles, or one which includes a carousal which moves the coin receptacles to a position directly below a coin distribution tube. For purposes of this application, the term "coin receptacle" is defined to include various types of coin containing elements including a coin bag, a coin container that collects unstacked coins, and a coin cartridge which collects stacked coins.

In an alternative embodiment, the coins are not sorted, but are simply counted by a coin counter and sent as mixed coins to the coin receptacle station. Because the coins are not sorted into denomination, the machine only requires one receptacle station. Thus, the flow of the mixed coins into a plurality of receptacles at the one coin station can be controlled by the machine.

The currency processing machine may be connected to a host system which controls various operational functions of the machine. For example, the host system may receive a signal from the currency processing machine indicating when one or more of the coin receptacles for a specific denomination are full and require an exchange with an empty coin receptacle. The host system may also include coin management software which controls the manner in which coins are placed in receptacles. For example, the coin management software of the host system may instruct a certain currency processing machine to fill one type of coin receptacle while other currency processing machines fill a different type of coin receptacle. Alternatively, the coin management software of the host system may instruct each currency processing machine with time-dependent coin filling algorithms. For example, the currency processing machine may fill all of its coin bags during the morning, while filling its coin cartridges during the afternoon.

Further, in a casino environment, the coin management software of the host system may be connected to a gaming machine network which informs the host system of the coin demands of specific gaming machines throughout the casino. Thus, the coin management software may instruct certain currency processing machines at specific locations of the casino to fill a certain type of coin receptacle to meet the coin demands of gaming machines that are in the proximity of such a currency processing machine.

The currency processing machine may also include a receptacle sealing device within each coin receptacle station. Thus, after a coin receptacle has been filled, it can be sealed to provide for a security measure against any attempts to tamper with the receptacle. The currency processing machine may also include security compartments for each denomination such that an authorized individual accessing one particular denomination will not have access to the coins for other denominations.

BRIEF DESCRIPTION OF THE DRAWINGS

Other objects and advantages of the invention will become apparent upon reading the following detail description in conjunction with the drawing in which.

DETAILED DESCRIPTION OF THE DRAWINGS

Figure 1:
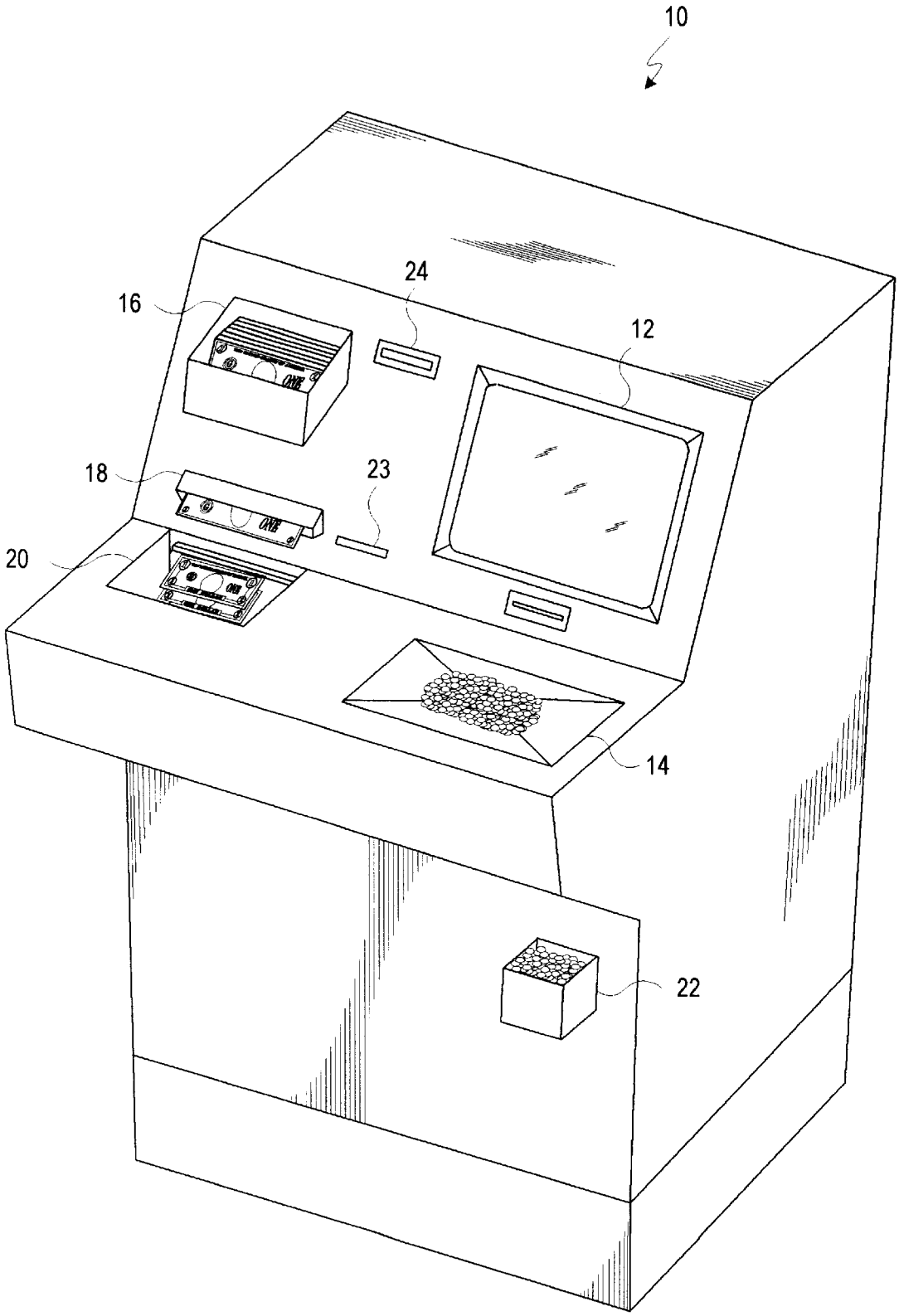
FIG. 1 is a perspective view of the currency processing machine of the present invention.

Referring now to FIG. 1, the currency processing machine 10 includes a touch screen 12 to provide inputs from a machine user and also to display outputs to be viewed by the user. While the touch screen 12 is the preferred mode to enter data from the user, the currency processing machine 10 may also include a mechanical keyboard to receive such inputs.

The currency processing machine 10 includes a coin receptacle 14 which receives coins of a single denomination or of a mixed denomination from a user. Additionally, a bank note receptacle 16 is included within the currency processing machine 10. The bank note receptacle 16 is illustrated in its open position in FIG. 1 and is retracted by the currency processing machine 10 once the bulk currency has been placed therein by the user. These input devices 14 and 16 allow the user of the currency processing machine 10 to input his or her funds which will ultimately be converted to some other sort of fund source that is available to the user. In addition to banknotes, the bank note receptacle 16 of the currency processing machine 10 can also accommodate casino scrip, paper tokens, or bar coded tickets.

The currency processing machine 10 includes a bank note dispenser 20 and a dispensed coin receptacle 22 for dispensing to the user the desired amount of funds in both bank notes and coins. A bank note return slot 18 may also be included within the currency processing machine to return notes to the user which cannot be authenticated. Coins which cannot be authenticated may be returned to the user via the dispensed coin receptacle 22. The currency processing machine 10 further includes a paper dispensing slot 23 for providing a user with a receipt of the transaction that he or she has performed.

In its simplest form, the currency processing machine 10 receives funds via the coin input receptacle 14 and the bank note receptacle 16, and after these deposited funds have been authenticated and counted, the currency processing machine 10 returns to the user an amount equal to the deposited funds but in a different variation of bank notes and coins. For example, the user of the currency processing machine 10 may input $102.99 in various small bank notes and pennies and in turn receive a $100 bank note, two $1 bank notes, three quarters, two dimes, and four pennies. Alternatively, the currency processing machine 10 may simply return a receipt of the transaction through the paper dispensing slot 23 which the user can redeem for funds by an attendant of the currency processing machine 10. Alternatively, the currency processing machine 10 can credit a user's account.

The currency processing machine 10 may also include a media reader slot 24 into which the user inserts his or her identification card so that the currency processing machine 10 can identify the user. The touch screen 12 typically provides the user with a menu of options which prompts the user to carry out a series of actions for identifying the user by displaying certain commands and requesting that the user depress touch keys on the touch screen 12 (e.g. a user PIN). The currency processing machine 10 has a media reader device which is capable of reading from or writing to one or more types of media. This media may include various types of memory storage technology such as magnetic storage, solid state memory devices, and optical devices.

Figure 2:
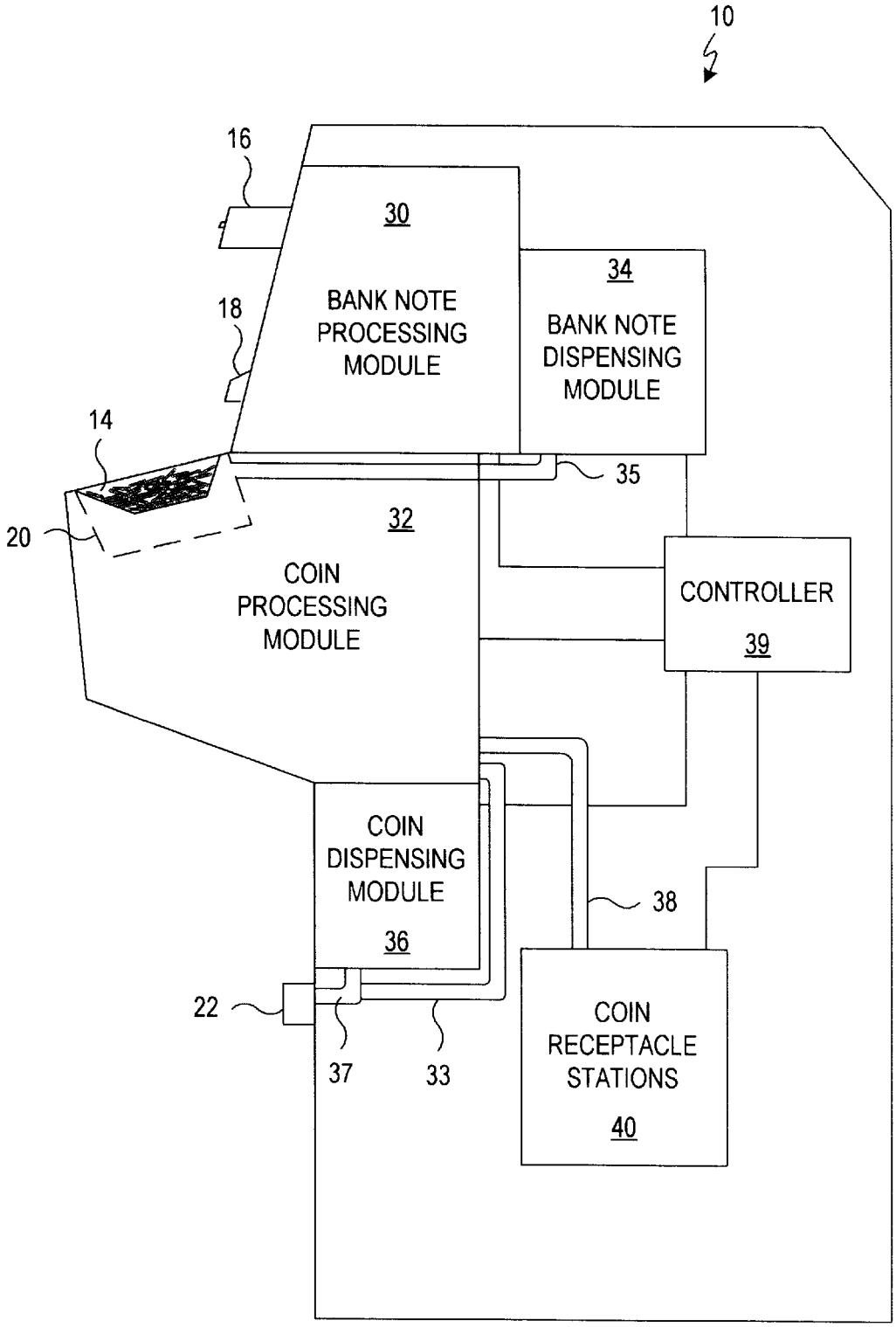
FIG. 2 is a side view of the currency processing machine of FIG. 1 which schematically illustrates the various modules present in the currency processing machine.

FIG. 2 illustrates the currency processing machine in a side view illustrating the various modules. The bank note processing module 30 receives bank notes from the bank note receptacle 16 for processing. The inward movement of the bank note receptacle 16 positions a stack of bills at the feed station of the bank note scanning and counting device which automatically feeds, counts, scans, authenticates, and sorts the bank notes, one at a time at a high rate of speed (e.g. at least 350 bills per minute). In place of or in addition to the bank note receptacle 16, the currency processing machine 10 may include a single bank note receptacle which receives and processes one bank note at a time. The bank notes that are recognized by the bank note processing module 30 are delivered to a currency canister of a type. When a bank note cannot be recognized by the bank note processing module 30, it is returned to the customer through the bank note return slot 18. Exemplary machines which scan, sort, count, and authenticate bills as required by the bank note processing module are described in U.S. Pat. Nos. 5,295,196, 5,970,497, 5,875,259 which are herein incorporated by reference in their entireties.

In place of or in addition to the bank note receptacle 16, the currency processing machine 10 may include a single bank note receptacle which receives and processes one bank note at a time. Such a single bank note receptacle would be placed at the front of the currency processing machine 10.

The currency processing machine 10 also includes a coin processing module 32. The coin processing module 32 sorts, counts and authenticates the mixed coins which are deposited in the coin input receptacle 14 which leads directly into the coin processing module 32. The coins are sorted in the coin processing module 32 in a variety of ways but the preferred method is a sorting based on the diameter of the coins. When a non-authenticated coin is determined by the coin processing module 32, it is directed through a coin reject tube 33 which leads to the dispensed coin receptacle 22. Thus, the user who has entered such a non-authenticated coin can retrieve the coin by accessing the dispensed coin receptacle 22. Coin sorting and authenticating devices which can perform the function of the coin processing module 32 are disclosed in U.S. Pat. Nos. 5,299,977, 5,453,047, 5,507379, 5,542,880, 5,865,673, 5,997,395 which are herein incorporated by reference in their entireties. Alternatively, other coins sorters such as a rail sorted can be used to perform the function of the coin processing module 32.

The currency processing machine 10 further includes a bank note dispensing module 34 which is connected via transport mechanism 35 to the bank note dispenser 20 that is accessible by the user. The bank note dispensing module 34 typically dispenses loose bills in response to a request of the user for such bank notes. Also, the bank note dispensing module 34 may be configured to dispense strapped notes into the bank note dispenser 20 if that is desired. In one embodiment of the present invention, the user may select the denomination of the loose or strapped bills dispensed to the user.

The currency processing machine 10 also includes a coin dispensing module 36 which dispenses loose coins to the user via the dispensed coin receptacle 22. The coin dispensing module 36 is connected to the dispensed coin receptacle 22 via a coin tube 37. Thus, the user of the currency processing machine 10 has the ability to select the desired coin denominations that he or she will receive in response to a transaction.

The coins which have been sorted into their denomination by the coin processing module 32 are sent to coin tubes 38 which correspond to each specific denomination. The coin tubes 38 lead to a coin receptacle station 40 for each of the denominations that are to be sorted and authenticated by the coin processing module 32.

The currency processing machine 10 includes a controller 39 which is coupled to each module within the currency processing machine 10 and controls the interaction between each module. For example, the controller 39 may review the input totals from the funds processing modules 30 and 32 and direct an appropriate finds output via the funds dispensing modules 34 and 36. The controller 39 also directs the operation of the coin receptacle stations 40 as described below. While not shown, the controller 39 is also coupled to the media reader associated with the media reader slot 24 and also to the printer at the receipt dispenser 23, if these devices are present on the coin processing mechanism 10.

Figure 3:
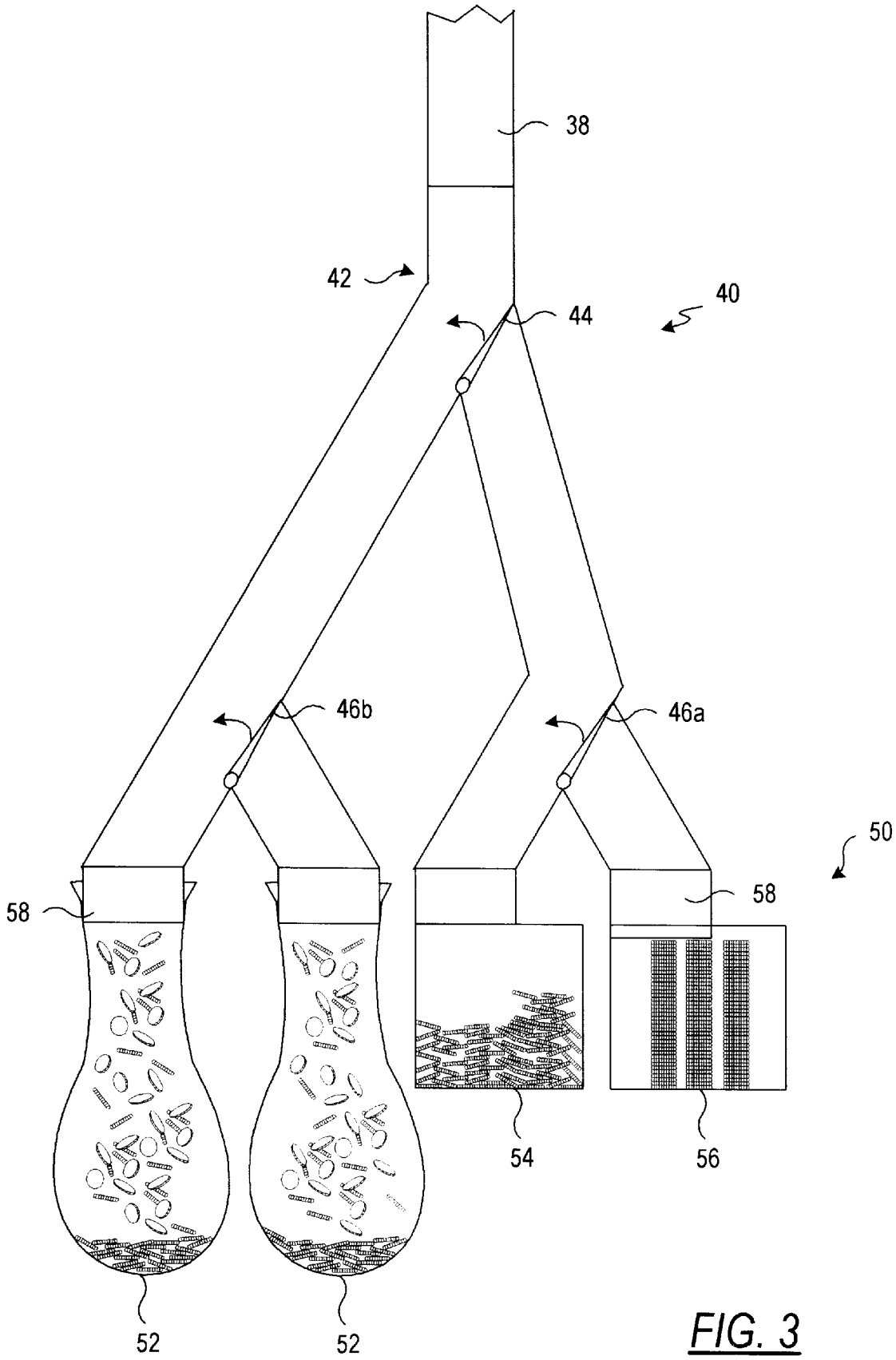
FIG. 3 illustrates a coin receptacle station of the currency processing machine which relies on a plurality of diverters to divert coins between specific coin receptacles.

FIG. 3 illustrates one type of coin receptacle station 40 which includes a coin distribution device 42 having a primary diverter 44 and two secondary diverters 46. Essentially, the coin distribution device 42 has a double-Y configuration such that coins which flow from coin tube 38 for a particular denomination can be placed into four different coin receptacles 50. The coin receptacles 50 can be of a variety of types of common coin receptacles such as a coin bag 52 (either cloth or plastic), a coin container 54 (which is usually rigid), or a rigid coin cartridge 56 which is useful for storing stacked coins. Each of these coin receptacles 50 are attached to the coin distribution device 42 through a receptacle mounting mechanism 58. These coin receptacle mounting mechanisms 58 can be of a variety of devices including a pivotal clamp, a sliding clamp, or a quick release fastener among others. The purpose of these receptacle mounting mechanism 58 is to physically attach the coin receptacles 50 to the coin distribution device 42 and hold the coin receptacles 50 in place while they are being filled with coins.

A controller (not shown) for the coin receptacle station 40 moves the diverters 44, 46*a* and 46*b* in response to receiving a communication from the controller 39 of the currency processing machine 10 indicating that a switch of the coin flow between the coin receptacles 50 is necessary. The controller for the coin receptacle station 40 actuates motors or solenoids which moves the primary diverter 44 and or the secondary diverters 46*a* and 46*b*. Accordingly, the motors or solenoids, in conjunction with the primary diverter 44 and secondary diverters 46*a* and 46*b*, can be used to selectively distribute the coins to the appropriate coin receptacles 50. While the coin receptacle station 40 may have its own controller as stated, the controller 39 of the currency processing machine 10 may directly operate the solenoids or motors.

When the currency processing machine 10 is used in a casino environment, the coin bag 52 which is chosen for an installation within the coin receptacle stations 40 is of the type which is commonly referred to as a "hopper fill bag." The hopper fill bag contains a known amount of tokens which is used to replenish a slot machine or other gaming machine that dispenses some sort of jackpot payout. Accordingly, the currency processing machine 10 becomes the source for filled hopper fill bags that are available to be deposited in various gaming machines located throughout the casino.

It should also be noted that the number of coin receptacles 50 per coin station 40 can vary. While four are shown, the number of receptacles 50 can be less than or more than four. Further, there may be a need for simply one receptacle 50 at one or all of the stations 40. For example, the receptacle 50 may be the hopper fill bag described above such that the authorized casino employee simply exchanges the one hopper fill bag with an empty hopper fill bag. Also, in casino environments where the use of a particular token/coin denomination is more prevalent than other denominations (e.g. $1 tokens), the coin receptacle station 40 for such a denomination preferably has more coin receptacles 50 than the other denominations since these receptacles 50 may become filled at a higher frequency.

Furthermore, in an alternative embodiment, the coin processing module 32 only counts the coins and does not sort them. Or, it may tabulate the value of the coins that are processed without sorting them. In either of these situations, the coins are sent from the coin processing module 32 to the coin receptacle station 40 as mixed coins. Because the coins are not being sorted into denomination, the currency processing machine 10 only requires one receptacle station 40 which collects all of the mixed coins. Thus, the flow of the mixed coins into a plurality of receptacles 50 at the one coin receptacle station 40 can be controlled by the currency processing machine 10 and, as discussed below, by an external host system.

Figure 4:
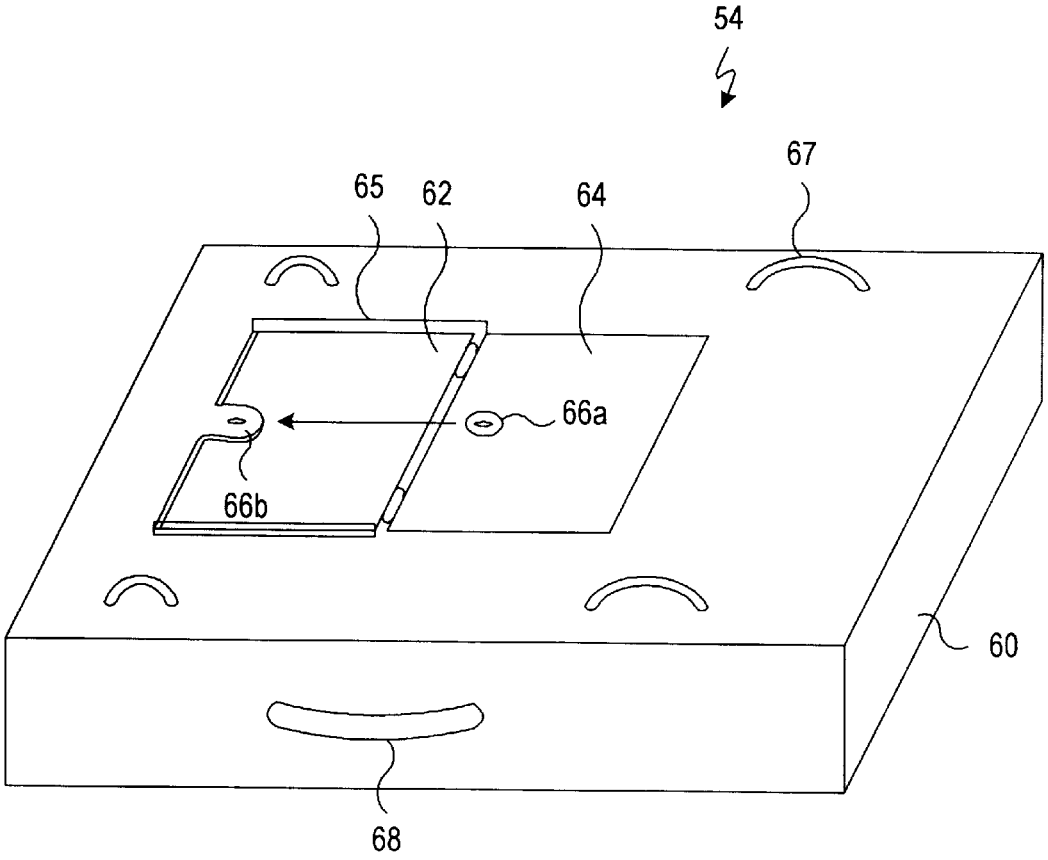
FIG. 4 illustrates a coin container that is useful in the currency processing machine.

FIG. 4 illustrates in more detail the type of coin receptacle 50 which has been referred to as the rigid container 54. The rigid container 54 includes a housing 60 made typically of a hard polymeric material or a metal. The housing 60 includes an opening 62 which is aligned with one of the output apertures of the coin distribution device 42 shown in FIG. 3. The opening 62 can be closed via a sliding door 64 which moves along a pair of guide structures 65 on the sides of the opening 62. The door 64 includes a locking structure 66*a* which mates with a corresponding locking structure on 66*b* on the housing 60 to provide security to the rigid coin container 54.

Additionally, the rigid coin container 54 includes a structure which allows it to be mounted to one of the receptacle mounting mechanisms 58. As shown, the rigid container 54 includes a plurality of hook mounts 67 which would mate with projecting fingers present on the receptacle mounting mechanism 58 to hold the rigid container 54 in place. However, several other mounting mechanisms are available and can be used on the rigid container 54. The rigid container 54 preferably includes a handle 68 such that the operator of the currency processing machine can easily grasp the rigid container 54 when manually transporting it.

Figure 5:
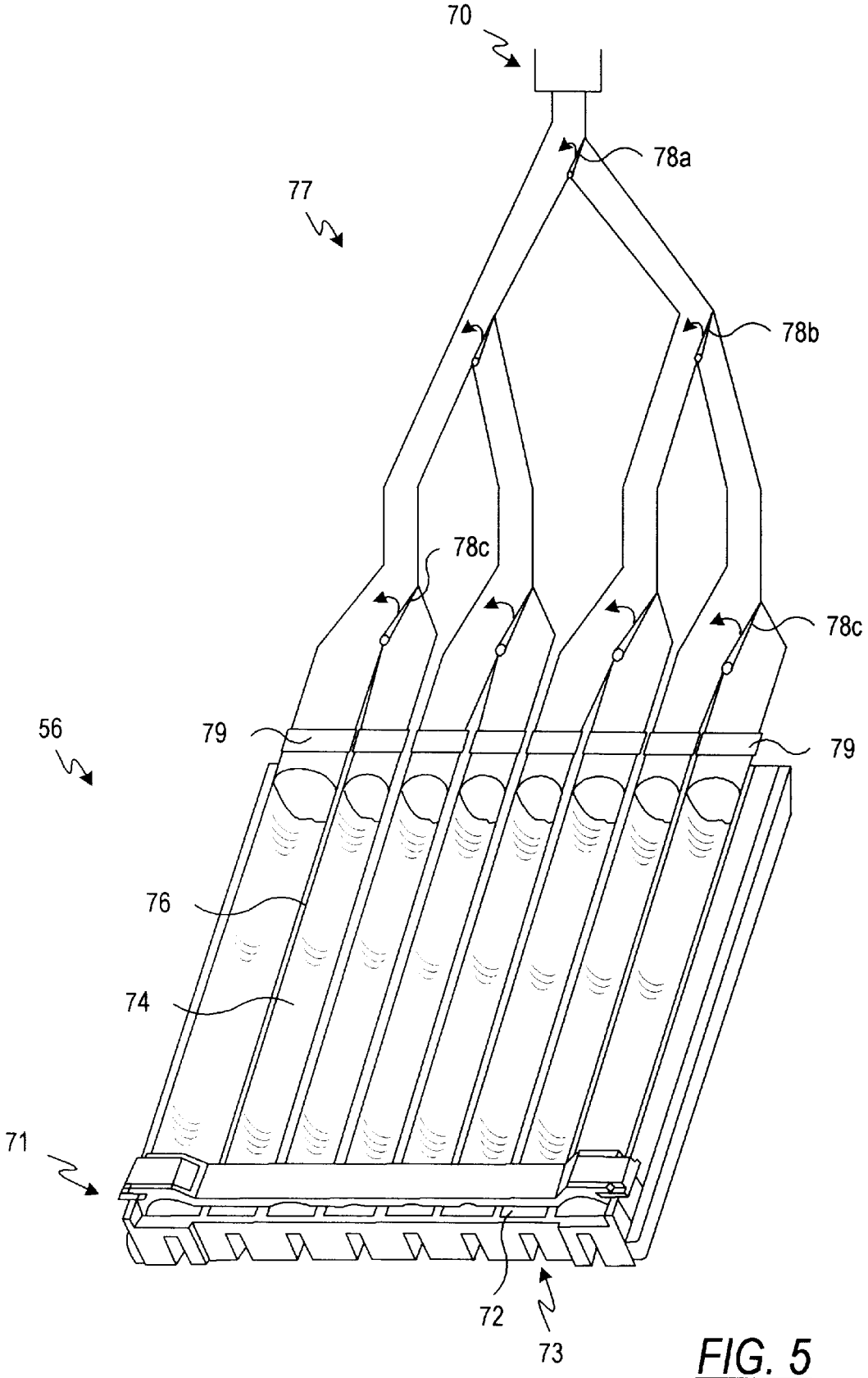
FIG. 5 illustrates one type of coin cartridge which is useful as a coin receptacle for the currency processing machine.

FIG. 5 illustrates one type of coin cartridge 56 which is useful for storing stacks of coins of a particular denomination. The coin cartridge 56 includes an entry end 70 and a discharge end 71. The entry end 70 receives coins from the distribution device 42 (FIG. 3) after they have been sent from the coin processing module 32 through the coin tube 38. The discharge end 71 is useful when the coin cartridge 56 is removed from the currency processing machine 10 and placed in a different machine where the discharge of coins is required. For example, after being filled by the currency processing machine 10, the coin cartridge 56 can then be placed into a common change machine where a bank note is deposited and coins of a particular denomination are discharged in response to the receipt of the bank note. The discharge end 71 includes a discharge slot 72 through which coins are dispensed from the cartridge 56 by moving a plunger type device through access region 73.

Preferably, the coin cartridge 56 includes a plurality of semi-cylindrical coin recesses 74 which are spaced from each other by a separating structure 76. This allows for several stacks of coins of a particular denomination to be held within one coin cartridge 56. The coin cartridge 56 may include a cover not shown which is placed adjacent to but spaced from the main body shown in FIG. 5 such that when the cartridge 56 is full, it can be entirely closed by the cover for transportation. Alternatively, the separating structures 76 may be positioned around more than 180° of the coin stacks so that the coins are retained therein and only the edges of the coins in the stacks are visible.

The coin cartridge 56 receives coins from a coin distributor 77 near the entry end 70. The coin distributor 77 includes a plurality of diverters 78 including a primary diverter 78*a*, two secondary diverters 78*b*, and four tertiary diverters 78*c*. The coin distributor 77 may also include a stacking mechanism 79 which can be a coin stacking shutter/platform as used in a coin wrapping machine to hold coins in a stack before wrapping. This ensures that the coins lie within a stack that will fit into the cylindrical coin recess 74. Alternatively, the stacking mechanism 79 may simply include a funnel device which assists in the coins lying flat as they enter the cylindrical coin recesses 74.

In a preferred embodiment, the coin cartridge 56 that is filled by the coin receptacle stations 40 for each denomination is the same type of coin cartridge that is used by the coin dispensing module 36 (FIG. 2). When the controller 39 of the currency processing machine 10 detects that the coin dispensing module 36 is low in coins of a particular denomination, the cartridge 56 from the coin receptacle station 40 within that currency processing machine 10 can be used to replenish the coin cartridge within the coin dispensing module 36. Thus, by providing a coin cartridge 56 that is compatible with both the coin dispensing module 36 and the coin receptacle station 40, the currency processing machine 10 can recycle coins which are deposited by users.

Further, if the design of the coin cartridge 56 is chosen to be compatible with the standard coin cartridges present in various coin-dispensing machines throughout a casino, the coin cartridges 56 that are filled within each coin receptacle station 40 can be used for replenishing an empty coin cartridge in those machines (e.g. a slot machine or a change machine). In other words, the currency processing machine 10 would be the source for filled coin cartridges to be placed in various machines throughout the casino that dispense coins via coin cartridges.

Alternatively, the coin receptacle station 40 may have a coin conveyor that is positioned in place of one of the coin receptacles 50 that are filled at a coin receptacle station 40. The coin conveyor would receive coins from the coin processing module 32 and directly transport coins of a particular denomination from a coin receptacle station 40 to the coin dispensing modules 36 so that coins can be continuously recirculated between the coin receptacle station 40 and the coin dispensing modules 36.

Furthermore, each of the coin receptacle stations 40 may include, instead of one of the coin receptacles 50, a conveyor system which securely transports coins from the back of the currency processing machine 10 to, for example, a casino money room or bank vault. Thus, coins may be directly removed from the currency processing machine 10 as opposed to being received in the coin receptacles 50. If the currency processing machine 10 is used in a casino environment, the conveyor which is coupled to the coin receptacle stations 40 may lead directly to an adjacent gaming machine such that the currency processing machine 10 is used for recycling coins or tokens to that adjacent gaming machine.

Figure 6:
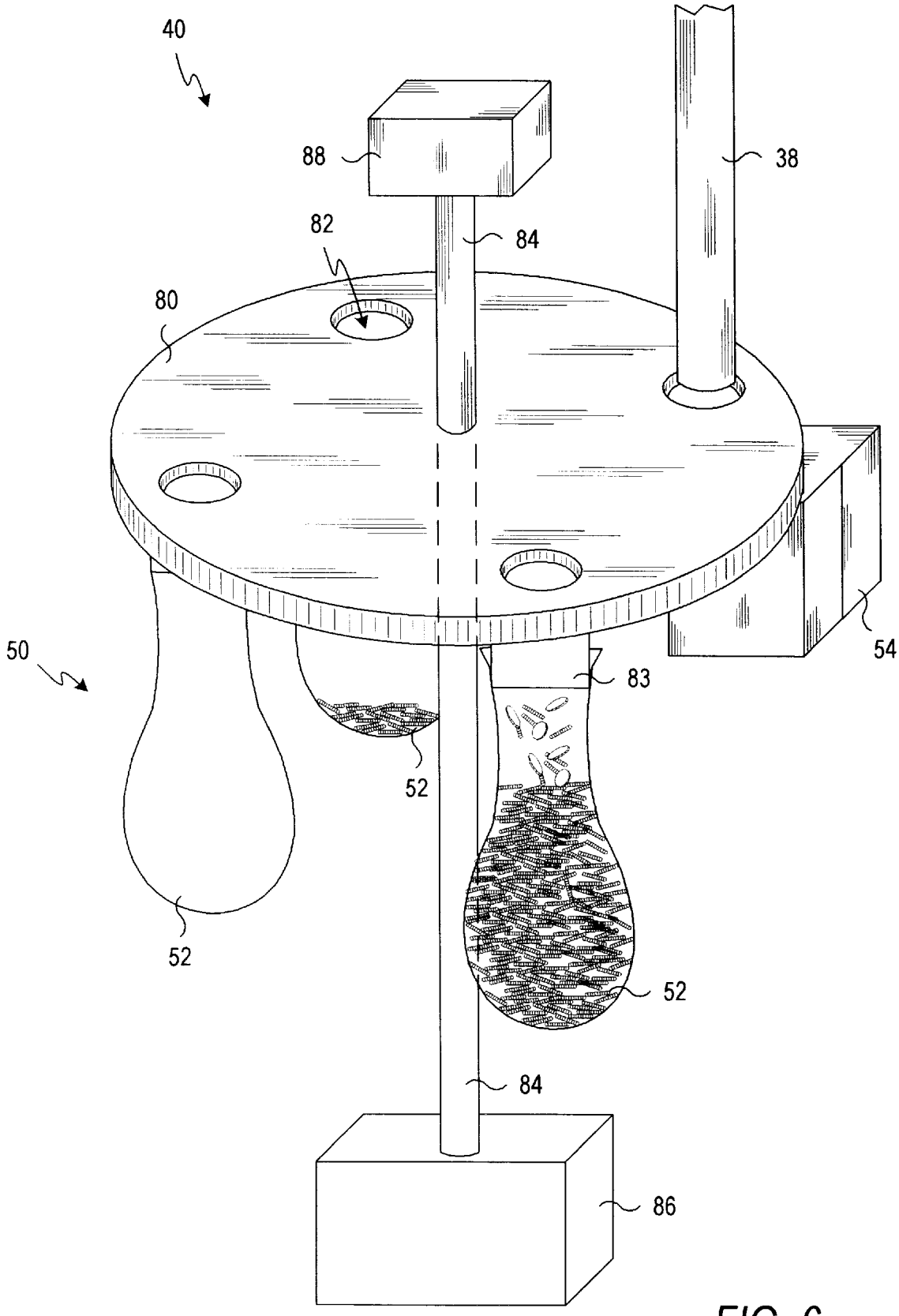
FIG. 6 illustrates an alternative coin distribution mechanism for a coin receptacle station which employs a moving carousel to move the coin receptacles below a coin distribution.

FIG. 6 illustrates an alternative coin receptacle station 40 which includes a carousel 80 having a plurality of apertures 82. Below each aperture 82 is a coin receptacle mounting mechanism 83 for mounting a coin receptacle 50. As shown, the number of apertures 82 is four for feeding coins into four different coin receptacles 50. In the embodiment shown in FIG. 6, the four coin receptacles being used are three coin bags 52 and one rigid coin container 54.

The carousel 80 is mounted to a shaft 84 which is driven by a motor 86. A bearing support 88 opposes the motor 86 and supports the shaft 84. The center point of the carousel 80, where the shaft 84 intersects the carousel 80, is at a fixed position relative to the coin tube 38 which is discharging coins of one coin denomination from the coin processing module 32. The apertures 82 are positioned on a radius from the central point of the carousel 80 that is equal to the distance separating the coin tube 38 from the center point of the carousel 80. Thus, as the carousel 80 rotates via the motor 86, each of the apertures 82 can be moved directly under the coin tube 38.

The motor 86 is controlled by the controller of the coin receptacle station 40. In response to the controller for the coin receptacle station 40 receiving a signal from the controller 39 for the currency processing machine 10 indicating that the coins should be deposited into a different coin receptacle 50, the motor 86 is actuated and rotates the carousel 80 so that the desired aperture 82 (and coin receptacle) is placed under the coin tube 38. The controller 39 for the currency processing machine 10 sends this instruction in response to a preselected number of coins entering a certain coin receptacle 50, as counted by the coin processing module 32, or in response to a demand to fill a specific type of coin receptacle 50 (e.g. a need for coin hopper fill bags in a casino). Alternatively, the motor 86 can be directly controlled by the controller 39 for the coin processing machine 10.

Figure 7:
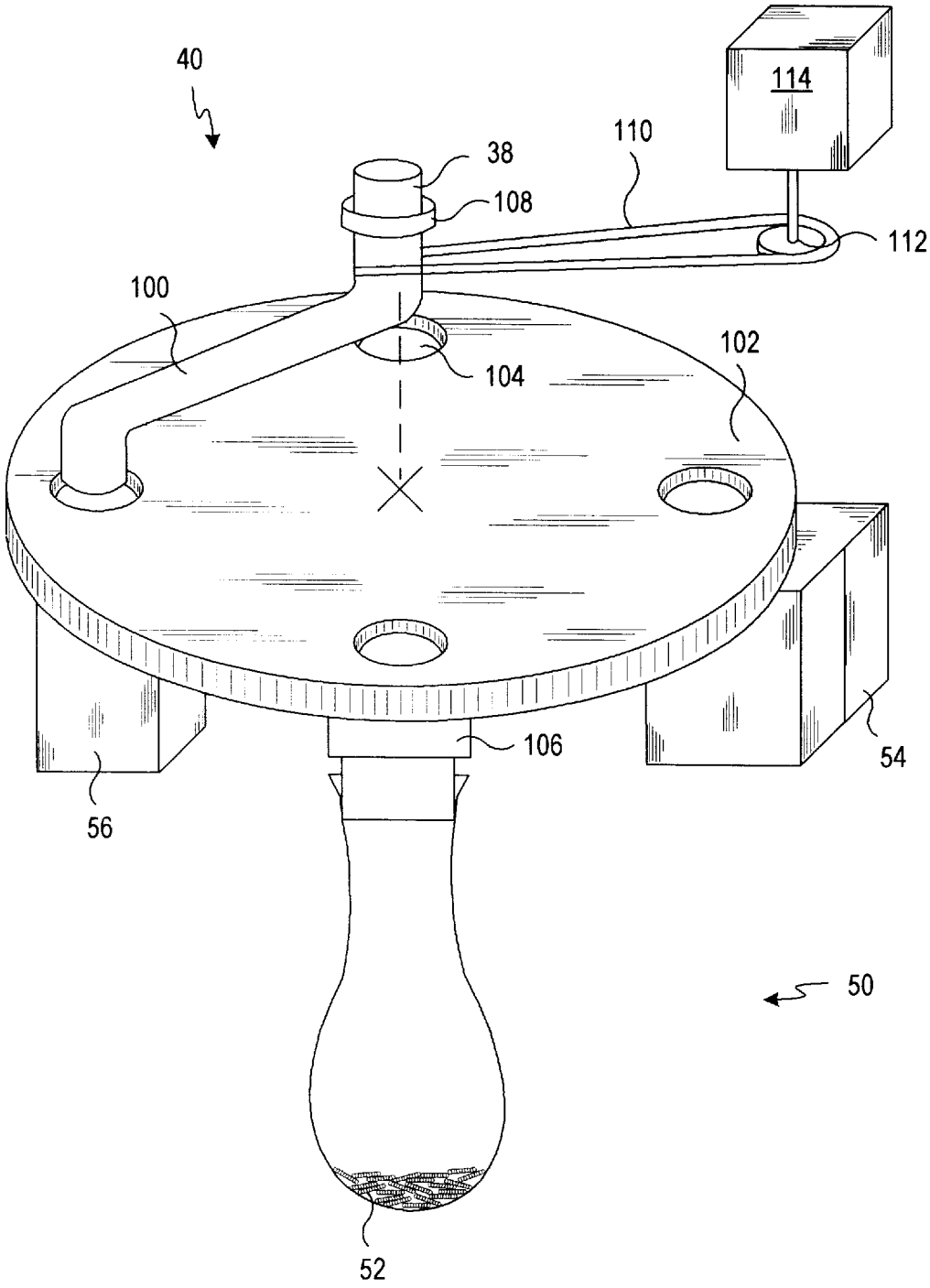
FIG. 7 illustrates an alternative coin distribution mechanism which employs a movable coin distribution tube to direct coins to coin receptacles.

Referring now to FIG. 7, another alternative coin receptacle station 40 is illustrated which includes a rotatable distribution tube 100 which is attached to the coin tube 38 that is coupled to the coin processing module 32. A platform 102 has a plurality of apertures 104 through which the coins pass after leaving the rotatable distribution tube 100. Below each of the apertures 104 is a receptacle mounting structure 106 allowing for the attachment of the coin receptacles 50, which as shown in FIG. 7, are a coin bag 52, a rigid coin container 54, and a coin cartridge 56.

To allow the rotatable distribution tube 100 to rotate around the coin tube 38, a bearing element 108 is present at the interface of these two tubes. A belt 110 which is coupled to a rotational driver 112 is also attached to the rotatable distribution tube 100. The driver 112 is coupled to a motor 114 which is controlled by the controller for the coin receptacle station 40. Alternatively, the motor 114 can be directly controlled by the controller 39 of the currency processing machine 10.

The coin tube 38 is generally centered over the central point of the platform 102. The rotatable distribution tube 100 has a radius defined between its entrance portion adjacent to the coin tube 38 and its exit portion through which the coins are discharged. This radius corresponds substantially to the radius at which each of the apertures 104 is placed relative to the central point of the platform 102. Thus, rotation of the rotatable distribution tube 100 causes its exit portion to be moved between apertures 104 in response to the controller 39 of the currency processing machine directing the coin receptacle station 40 to change the flow of coins to a particular coin receptacle 50.

While the invention has been described thus far with three alternative coin distribution mechanisms within the coin receptacle station 40, other possible configurations exist as well. For example, the coins may be distributed from a coin tube to one receptacle 50 which, after being filled or in response to a demand for a different receptacle that must be filled, is physically moved away from the coin tube and automatically replaced by the alternate receptacle. Such a configuration can be accomplished, for example, by moving the receptacles 50 on a chain and gear arrangement. Further, the receptacles 50, once filled, can be transported to a secondary transport system which moves the filled receptacles to a desired location within the currency processing machine 10 or removes the filled receptacles from the currency processing machine 10. Such a secondary transport mechanism may be, for example, a conveyer system.

Figure 8:
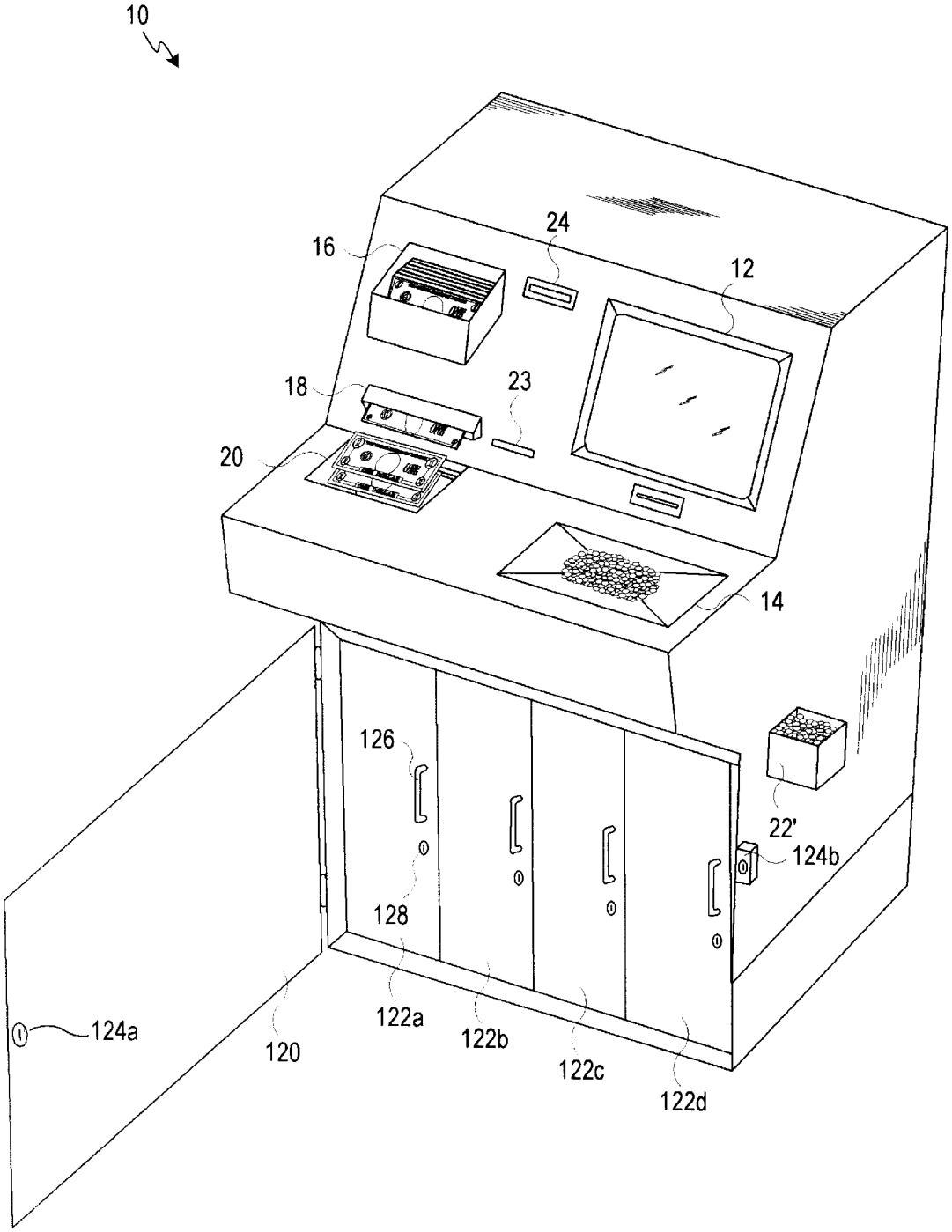
FIG. 8 is a perspective view of the currency processing machine in FIG. 1 which includes security doors for each denomination.

Referring now to FIG. 8, the currency processing machine 10 shown is similar to the currency processing machine in FIG. 1 but includes a primary security door 120 leading to a plurality of denominational specific doors 122*a–d*. The primary security door 120 includes the primary lock 124*a* and 124*b* located on the door and the housing, respectively, of the currency processing machine 10. Each of the denominational specific security doors 122 also includes a handle 126 and also a lock 128. The dispensed coin receptacle 22 which is shown in FIG. 1 as being located in the front of the coin processing machine 10 has been moved to the side of the machine as coin receptacle 22' in FIG. 8. Alternatively, this dispensed coin receptacle 22 could be placed on the front of the coin processing machine 10 as a recess which is adjacent to the coin input receptacle 14 or the bank note dispenser 20.

The denomination specific security doors 122 allow for access to a single coin denomination having coin receptacles 50 which must be exchanged or otherwise accessed. Thus, authorized personnel will not have access to the coin receptacles 50 of the other denominations while performing functions relative to the coin denomination requiring attention.

This security process can be further enhanced by utilization of the media reader slot 24 on the currency processing machine 10. Here, the authorized personnel would first insert a card to the media reader slot 24 which identifies him or her as a particular authorized person. The locks 128 for each denominational specific security door are electronically connected to the controller 39 of the currency processing machine 10. Thus, after the authorized person has entered his or her card into the media reader slot 24 and opens a particular denominational specific security door 122, this action is logged into the memory of the currency processing machine 10. Accordingly, the currency processing machine 10 keeps track of which of the authorized personnel had access to which denominational specific security door 122. In a further alternative to this security system, each of the coin receptacle mounting structures (e.g. mounting structure 106 in FIG. 7) can be electronically connected to the controller 39 for the currency processing machine 10 such that the activities with respect to each specific coin receptacle 50 within each coin receptacle stations 40 are monitored.

Figure 9A:
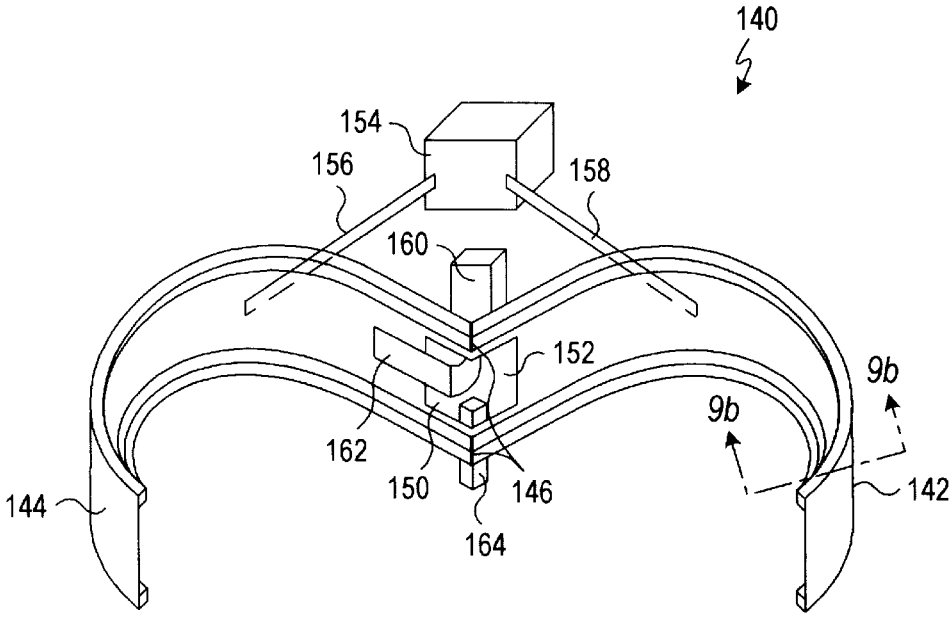
FIGS. 9*a*–9*c* illustrate one type of bag sealing device which is useful in the currency processing machine.
Figure 9B:
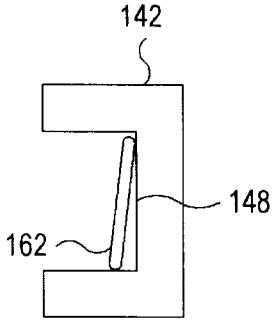
Figure 9C:
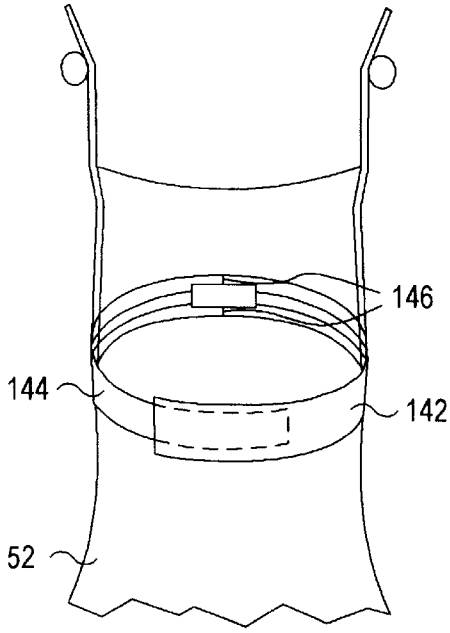

Referring now to FIGS. 9*a*–9*c*, a bag sealing device 140 is illustrated which includes a right crimp arm 142 and a left crimp arm 144. The arms 142 and 144 are connected at their ends by a hinge 146. As shown best in FIG. 9*b*, each of the crimp arms 142 and 144 includes a seal guide surface 148 which is recessed from the innermost surface of the respective arms 142 and 144.

Near the hinge 146, the right crimp arm 142 and left crimp arm 144 include apertures 150 and 152, respectively. The aperture 150 provides an entrance for the sealing media 162 (e.g. a wire, a tape which includes an internal metal structure, or tape with adhesive) into the crimp arms 142 and 144 after the crimp arms 142 and 144 have been clamped around the coin bag 52 as shown in FIG. 9*c*. In their clamping position, the end of the left crimp arm 144 fits within the guide surface 148 of the right crimp arm 142. The sealing media 162 moves along the sealing guide surface 148 of the two arms before eventually returning to the aperture 152 where it exits from the arms 142 and 144.

The bag sealing device 140 includes a feed mechanism 160 for moving the seal media 162 through the apertures 152 when the crimp arms 142 and 144 are in their crimping position as shown in FIG. 9*c*. After the leading end of the seal media 162 has been wrapped around the circumference of the bag 52, the leading and trailing ends of the seal media 162 are attached by clamping mechanism 164 located adjacent to the apertures 150 and 152.

To move the crimp arms 142 and 144 to their closed position, at least one motor 154 is provided which has linkages 156 and 158 attached to the left crimp arm 144 and right crimp arm 142, respectively. Thus, when the coin receptacle is a coin bag 52 and a preselected number of coins has been deposited to the coin bag 52, the coin receptacle station 40 has the ability to provide a tamper-proof seal around the mouth of the bag 52. Such a bag sealing device 140 would be mounted adjacent to the receptacle mounting structure which holds the bag 52.

Alternatively, the sealing device 140 may simply employ a metallic band which can be placed around the bag near its mouth and crimped to close the mouth. The sealing device 140 would then require a component that places the band around the bag 52 and moves the free ends of band toward each other to clamp the bag 52 shut.

Figure 10:
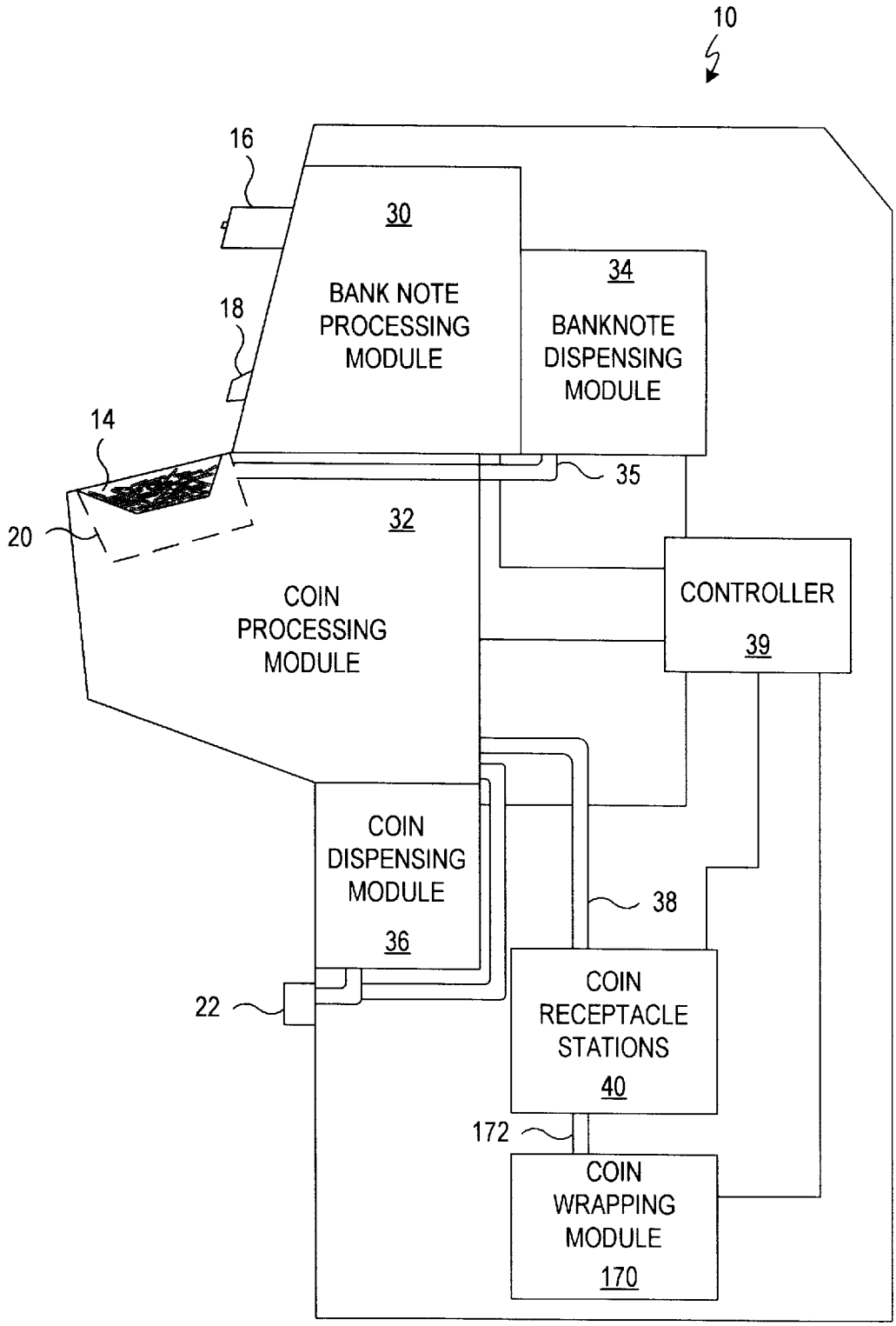
FIG. 10 illustrates an alternative embodiment to the currency processing machine which schematically illustrates the use of a coin wrapping module in connection with the coin receptacle stations.

Referring now to FIG. 10, the currency processing machine 10 disclosed is similar to that shown in FIG. 2, but includes an additional module. A coin wrapping module 170 is located below each of the coin receptacle stations 40 and is coupled thereto by a coin tube 172. To provide for the coin tube 172 in the alternative embodiments of the coin receptacle station 40 shown in FIGS. 3, 6 and 7, one of the coin receptacles 50 may be simply replaced by the coin tube 172 leading to the coin wrapping module 170. Thus, in addition to the currency processing machine I0 being able to select the desired type of coin receptacle 50 into which the flow of coins can be directed, the currency processing machine 10 includes the option of allowing coins to flow directly into a coin wrapping module 170 so that coins can be packaged by a standard wrapping machine. The coin wrapping module 170 can be one of many coin wrapping machines known in the art which includes a hopper into which coins are fed, a stacking station at which coins are stacked, and a wrapping station at which coins are wrapped. One such coin wrapper is claimed in U.S. Pat. No. 5,573,457 which is herein incorporated by reference in its entirety.

Figure 11:
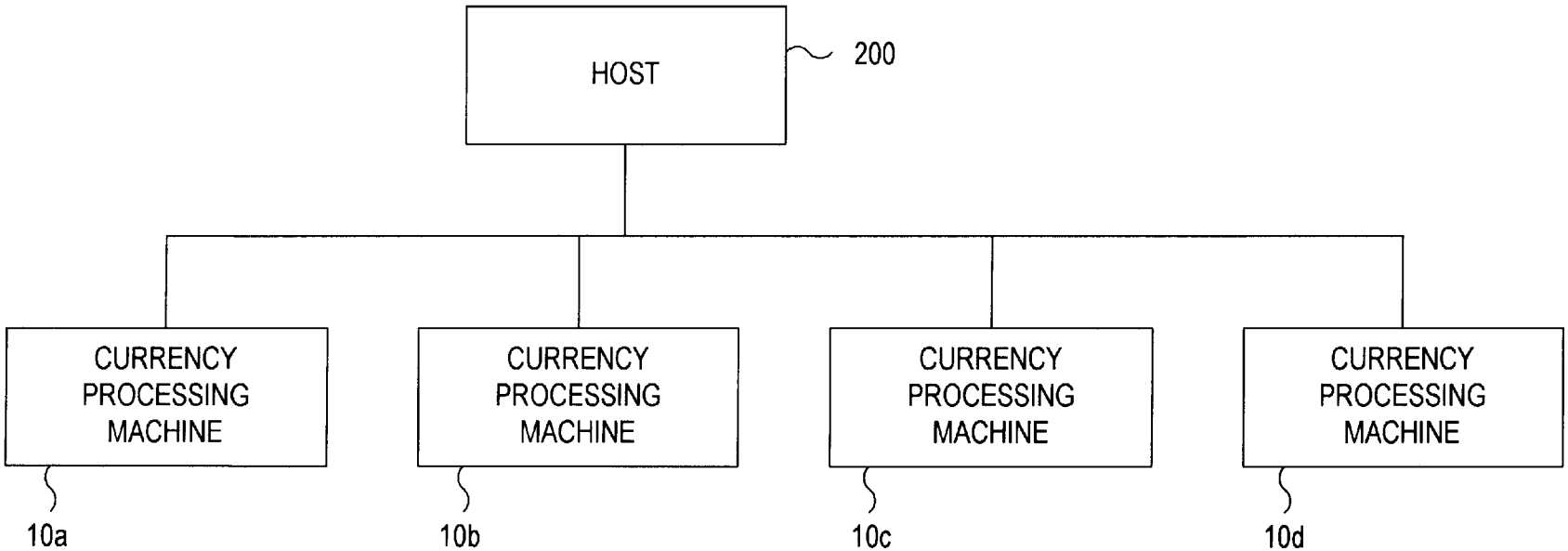
FIG. 11 schematically illustrates a network of currency processing machines connected to a host system.

Referring now to FIG. 11, a host system 200 is coupled to a plurality of currency processing machines 10*a*–10*d*. The host system 200 communicates with each currency processing machine 10*a*–10*d* to efficiently package the coins of each denomination in particular receptacles for further use. For example, in response to a need for filled coin cartridges 56 for a particular denomination, the host system 200 sends a signal to each of the currency processing machines 10*a*–10*d* to instruct them to begin filling coin cartridges 56 instead of filling coin bags 52 or rigid containers 54. Alternatively, if a demand for hopper fill bags used for filling gaming machines within a casino is experienced, the host system 200 may instruct currency processing machines 10*a*–10*d* to fill up their hopper fill bags for a particular denomination. Also, the coin processing machines 10*a*–10*d* send signals to the host system 200 when coin receptacles 50 are full or when a fault condition is encountered.

In effect, the host system 200 provides for a coin management system that externally controls the filling of the coin receptacles 50 (and possibly the wrapping of coins, see FIG. 10). In other words, while the currency processing machine 10 may rely on an internal signal to switch receptacles (i.e. when a filled bag is detected), the host system 200 controls the filling of coins receptacles 50 in response to conditions external to the currency processing machine 10.

Moreover, the host system 200 may link several currency processing machines 10 and provide for the efficient filling and distribution of coin receptacles 50. This is beneficial when, for example, after identifying the demand for one casino hopper fill bag, the host system 200 determines that two currency processing machines 10 are near a half bag level and instructs each currency processing machine 10 to fill each bag to only the half-bag level so that the two bags can be combined to fill the gaming machine with effectively one hopper fill bag. Thus, the filling of receptacles (or wrapping of coins, or flow of coins to a coin conveyer) may be a function of temporal limitations, demand for a particular type filled coin receptacle, or demand for a particular number of coins in one receptacle that is less than the typical coin fill level.

Moreover, the host system 200 may be connected to an accounting system which allows the user of the currency processing machine 10 to credit his or her account after making a deposit.

Figure 12:
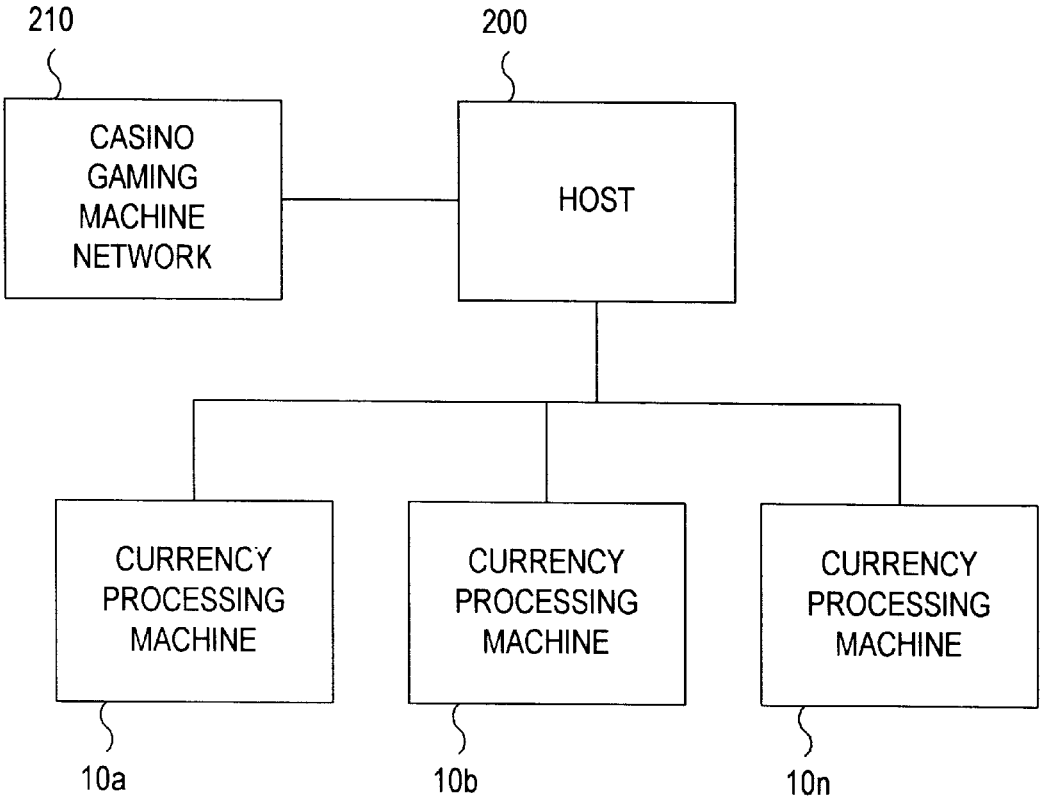
FIG. 12 schematically illustrates a network of currency processing machines in communication with a casino gaming machine network.

Referring now to FIG. 12, the host system 200 in communication with a plurality of currency processing machines 10*a*, 10*b*, . . . 10*n*, can be further coupled to a casino gaming machine network 210 to provide the host system 200 with real time demands for particular types of coin receptacles 50. The casino gaming machine network 210 is linked to various types of gaming machines throughout a casino and receives signals from each machine indicating whether the gaming machines are in need of coins of a particular denomination to provide, for example, a jackpot payout. When the casino gaming machine network 210 determines that a specific gaming machine is in need of a refill of coins, it sends a signal to the host system 200. Accordingly, knowing the position of a gaming machine in need of coins, the host system 200 directs the currency processing machine 10 which is nearest to that gaming machine to begin to fill its hopper fill bags to provide the replenishment of coins or tokens for that specific gaming machine. Alternatively, the host system 200 may determine which of the currency processing machines 10*a*–10*n* have such a coin bag 52 available for use to replenish the machine and instruct the casino gaming machine network 210 which currency processing machines 10*a*–10*n* should be accessed for replenishing the gaming machine in need of coins. To that end, because of the high number of gaming machines present in the casino and the constant need to be filling gaming machines which are low in coins, the host system 200 can continuously instruct the casino gaming machine network 210 as to availability of coin bags within the currency processing machines 10*a*–10*n* located throughout the casino.

Furthermore, it is possible to incorporate a printer within each currency processing machine 10 at each coin receptacle stations 40 to provide explicit instructions to the authorized personnel concerning the deployment of the filled receptacle. The host system 200, after receiving instructions from the casino gaming machine network 210 as to which of the gaming machines are in need of a refill of coins, then instructs a specific currency processing machine 10*a*–10*n* to develop a printed tag indicating the identification number for the gaming machine that will be replenished by the specific hopper fill bag. Such a printed sticker can then be placed along the side of the hopper fill bag such that the authorized person who is accessing the machine reads the sticker for instructions on which gaming machine to deposit the coin bag. In sum, knowing the relative positions between the currency processing machines 10*a*–10*n* and the gaming machines within the casino gaming machine network 210, the host system 200 employs basic algorithms to determine which of the currency processing machines 10*a*–10*n* nearest the gaming machine in need of a refill has available hopper fill bags and prints a sticker to be placed on the hopper fill bag 52 instructing the authorized personnel to transport the filled hopper fill bag to that gaming machine in need of a refill.

The printing of such a label can also be incorporated directly on to a tamper-proof security seal which was described generally with reference to FIG. 9. Thus, the coin bag 52 has a security seal which also identifies the specific gaming machine into which it should be placed.

Figure 13A:
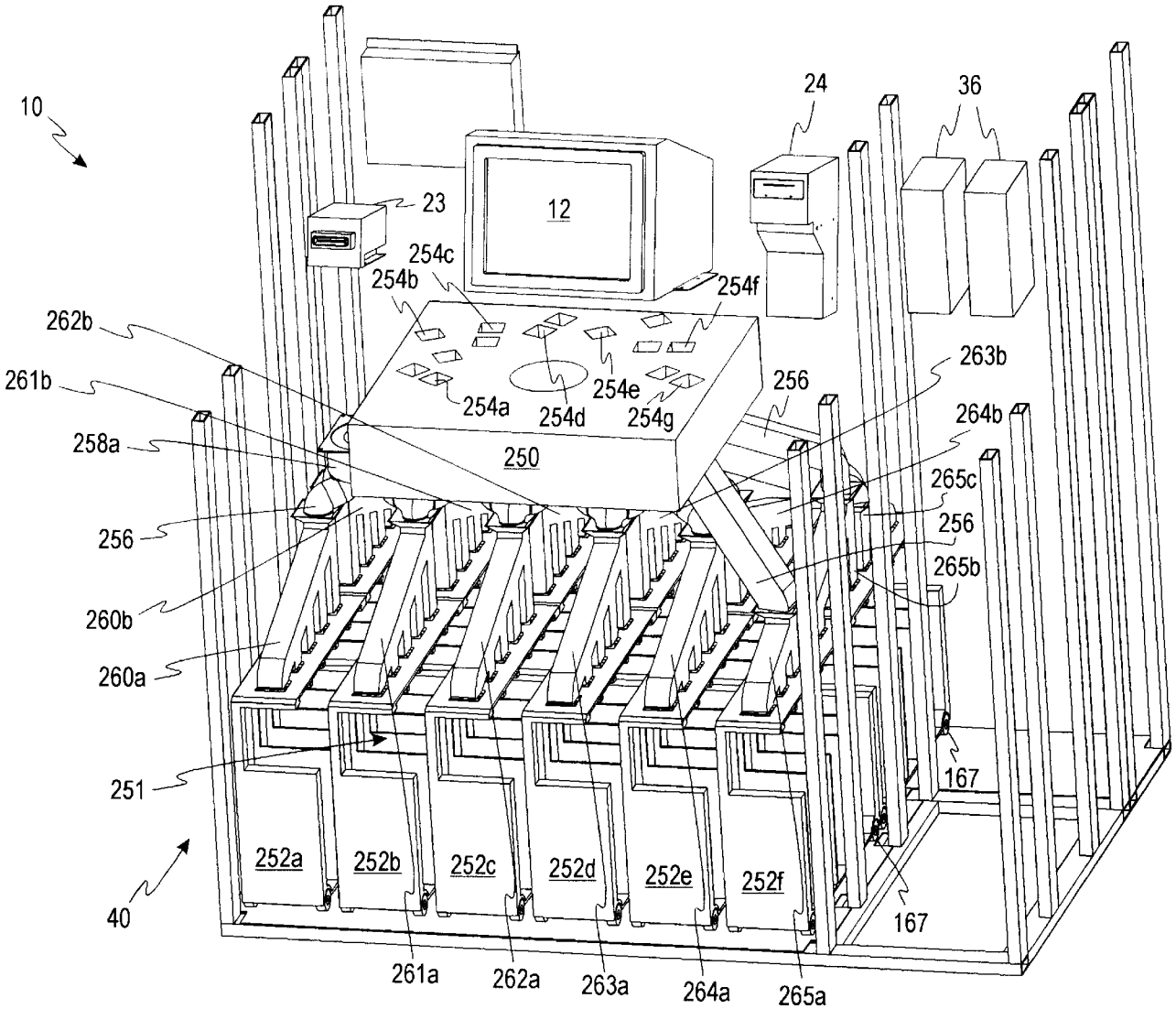
FIG. 13*a* is a front perspective view of a currency processing machine according to an embodiment of the present invention.
Figure 13B:
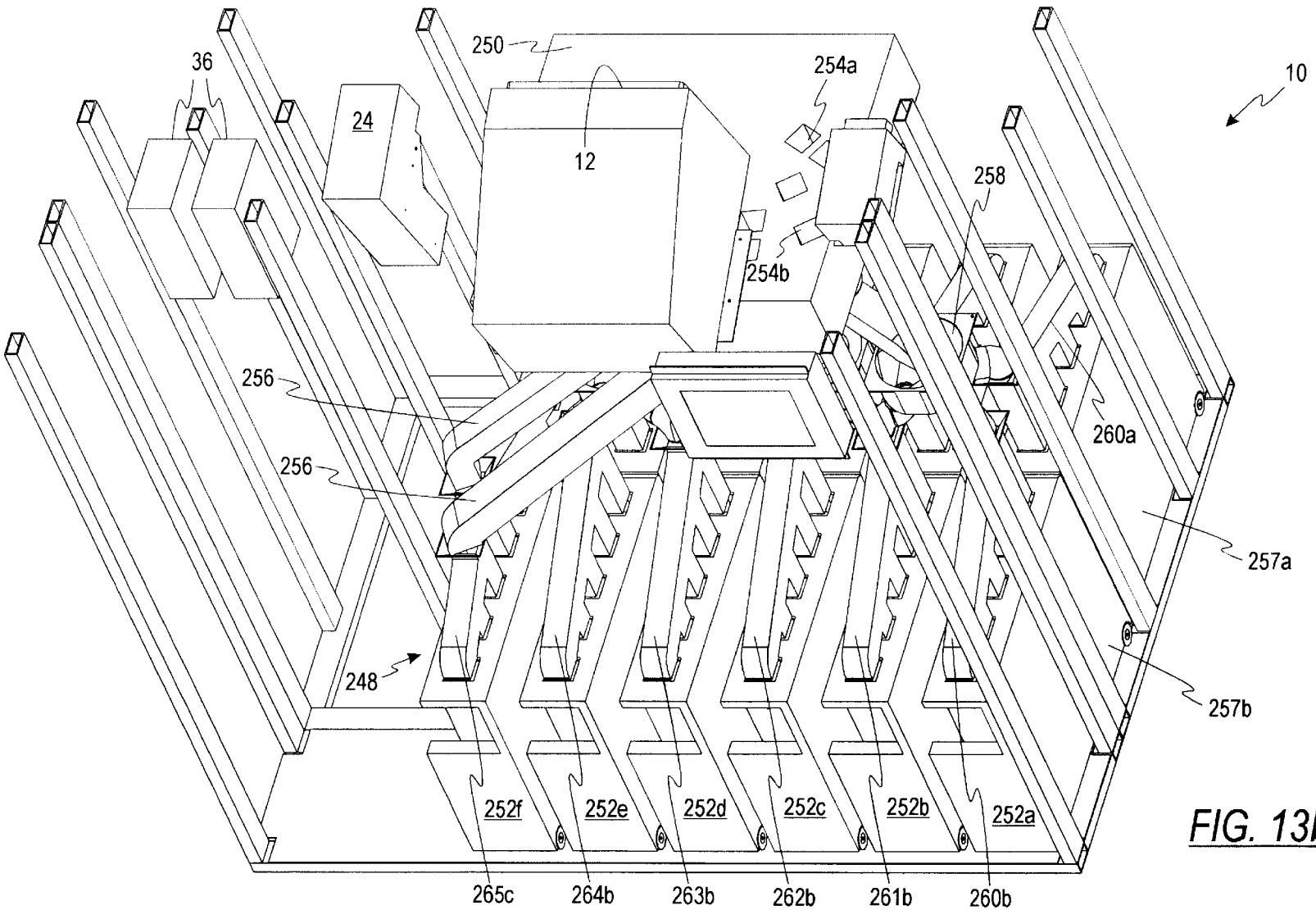
FIG. 13*b* is a rear perspective view of a currency processing machine according to an embodiment of the present invention.
Figure 13C:
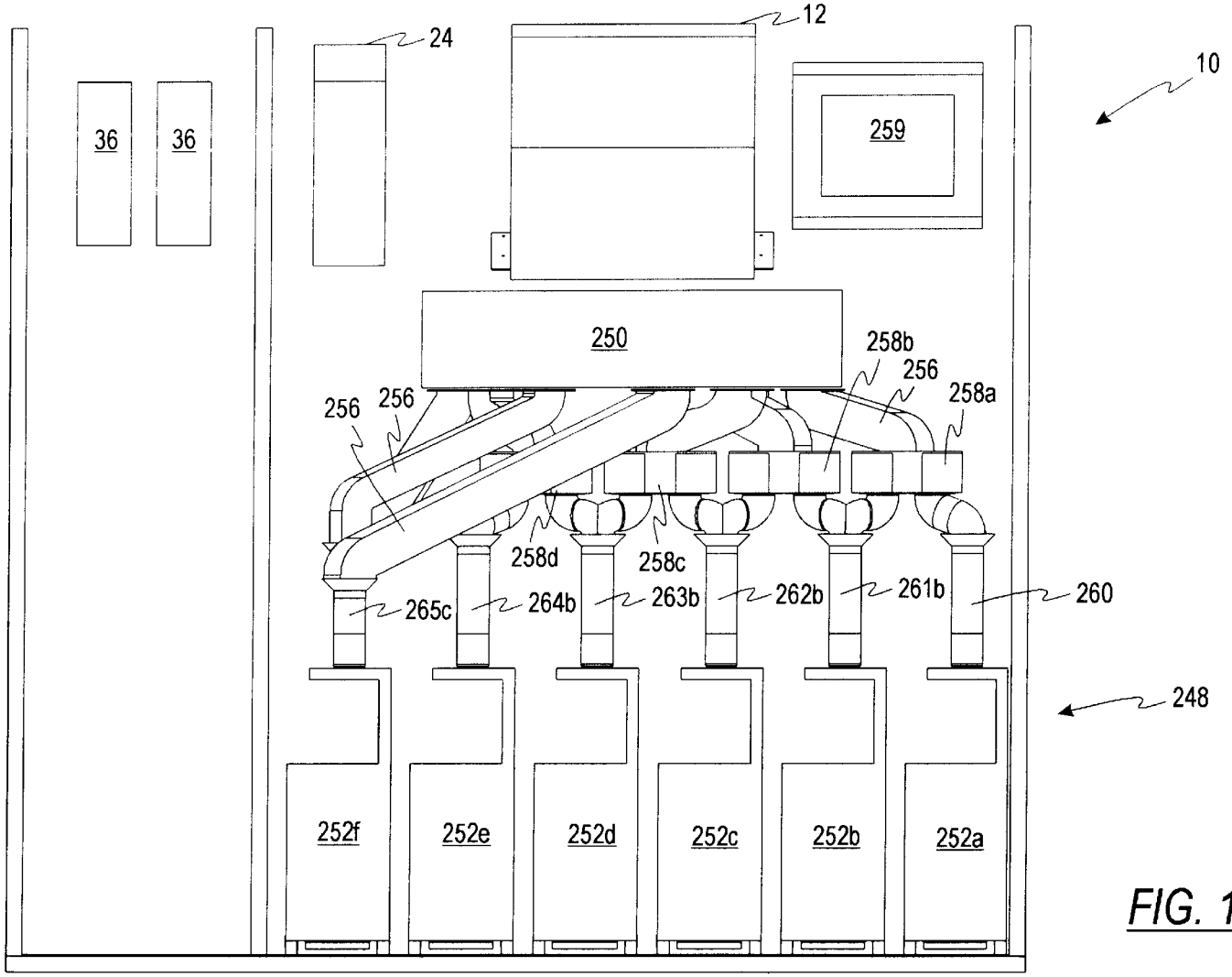
FIG. 13*c* is a back-side view of a currency processing machine according to an embodiment of the present invention.

FIGS. 13*a*, 13*b*, and 13*c* illustrate an embodiment of a coin distribution network 248 for the currency processing machine 10. The coin distribution network 248 is an alternative embodiment of the coin processing module 32 and the coin receptacle station 40 illustrated in FIG. 2. Coins are sorted with a coin processing module 250 and distributed into an array of coin receptacles 251 disposed below the coin processing module 250. The coin receptacles 251 are arranged into six columns 252*a*–*f*, each column containing 10 rows of coin receptacles 251. The illustrated coin processing module 250 contains seven coin exit channels 254*a*–*g* sorting up to seven denominations of coins/tokens. In the illustrated embodiment, coins sorted into six of the exit channels 254*b*–*g* are routed into the coin receptacles 251 while the seventh exit channel 254*a* is used to off-sort odd-sized or unwanted coins ("undesirables"). The currency processing machine 10 illustrated in FIG. 13*a* is designed to sort the following coin denominations: U.S. nickels, quarters, half-dollars and the one, two, and five dollar casino token. The undesirable coins can be routed to a back to a user via the dispensed coin receptacle 22 (FIG. 1) or into a coin receptacle such as one of the coin receptacles 251 illustrated in FIG. 13*a*.

The coin distribution network 248 routes coins from the exit channels 254*a*–*f* of the coin processing module 250 exit channels 254*a*–*f* to the array of coin receptacles 251 via a network of cooperating tubes 256, rotating coin distribution manifolds 258, and linear coin distribution manifolds 260–265. The linear coin distribution manifolds 260–265 channel coins into the individual coin receptacles 251 under the force of gravity. Each column of coin receptacles 252*a*–252*f* has at least two linear coin distribution manifolds disposed thereabove. For example, in the first column of coin receptacles 252*a*, a first linear distribution manifold 260*a* is disposed above the first five rows of coin receptacles 251 and a second linear distribution manifold 260*b* is disposed above the last five rows of coin receptacles 251. Likewise, linear coin distribution manifolds 261*a,b* correspond to column 252*b*, linear coin distribution manifolds 262*a,b* correspond to column 252*c*, linear coin distribution manifolds 263*a,b* correspond to column 252*d*, linear coin distribution manifolds 264*a,b* correspond to column 252*e*, and linear coin distribution manifolds 265*a,b,c* correspond to column 252*f*.

Each rotating distribution manifold 258*a*–*d*, which are best seen in FIG. 13*c*, distributes coins among two different columns of coin receptacles 252*a*–*f*. Each linear distribution manifold 260–265 distributes coins among the individual coin receptacles 251 in a single column 252*a*–*f*.

The coins exiting exit channels 254*b*–*g* are routed to the coin receptacles 251. Some coin denominations are routed directly from a coin exit channel 254 directly to a linear coin distribution manifold 260–265 while other coin denominations are first routed through one of the rotating coin distribution manifolds 258 and then to a linear coin distribution manifold 260–265. In the former instance, for example, coins sorted via coin exit channel 254*d* are routed directly to the linear coin distribution manifold 269*c*. In the later instance, for example, coins sorted via coin exit channel 254*b* are first directed into the rotating coin manifold 258*a*. The rotating coin manifold 258*a* can then distribute the coins into the coin receptacles 251 located in columns 252*a* or 252*b*. In an alternative embodiment, an exit channel (such as exit channel 254*a*, for example) can be routed directly to an individual coin receptacle 251. In such an embodiment, a tube 256 would extend directly from the exit channel 254 to the coin receptacle 251. Table 1 delineates the various routes coins exiting from the coin channels 254*a–g* may travel to the coin receptacles 251 in the illustrated embodiment of the currency processing machine 10.

TABLE 1

| Exit Channel | Coin Denomination | Rotating Manifold | Column | Linear Manifold |
|---|---|---|---|---|
| 254a | Undesirables | None | None | None |
| 254b | U.S. Nickel | 258a | 252a, 252b | 260a, 260b, 261a, 261b |
| 254c | U.S. Quarter | 258b,258c | 252b, 252c, 252d | 261a, 261b, 262a, 262b, 263a, 263b |
| 254d | U.S. Half-Dollar | None | 252f | 265c |
| 256e | $2 casino token | None | 252f | 265b |
| 256f | $1 casino token | 258d | 252d, 252e | 263a, 263b, 264a, 264b |
| 256g | $5 casino token | None | 252f | 265a |

As can be seen from Table 1, the currency processing machine 10 handles coins of the following denominations: U.S. nickels, U.S. quarters, U.S. half-dollars, $2 casino tokens, $1 casino tokens, and $5 casino tokens. In alternative embodiments of the present invention, the coin processing module 250 is designed to handle other denominations of coins. Further, the coin exit channels 254*a–g*, the rotating coin manifolds 258*a–d*, the coin tubes 256, and the linear distribution manifolds 260–265 can be arranged to route denominations of coins into as few as one coin receptacle 251 or as many columns 252 of coin receptacles 251 as desired. The particular arrangement is a function of the nature of the operator's business and the variety of coin denominations that the operator encounters on a daily basis. The inventors have found that the illustrated embodiment is suited for large casino-type operations. In other alternative embodiments, the currency handling machine 10 can accommodate other coin denominations including coins from most internationally currencies such as, for example the Euro as well as other casino tokens and transit tokens.

The desired mode of operation of the coin distribution network 248 can be dictated by the operator via an operator interface 259. Essentially, the operator instructs the machine 10 which coin receptacles 251 are to be dedicated to which coin denominations or combination of coin denominations. For example, U.S. quarters are sorted out of exit channels 254*c* and into the second and the third rotating manifolds 258*b*, 258*c*. The second and third rotating manifolds 258*b*, 258*c* are capable of distributing coins among the third, forth, and fifth columns 252*b*, 252*c*, 252*d* which include thirty coin receptacles 251. However, the first rotating coin distribution manifold 258*a* is cable of distributing nickels in the second column 252*b* and the forth rotating coin distribution manifold 252*d* is capable of distributing $1 casino tokens in the fourth columns 252*d*. Accordingly, a decision is made as to which of the coin receptacles 251 within the second column 252 are to be dedicated to nickels or quarters and which of the coin receptacles 251 within the forth column 252*d* are to be dedicated to $1 casino tokens or quarters. The operator can make this decision and instruct the currency processing machine 10 via the operator interface 259 appropriately. Alternatively, an operator can select, via the operator interface 259, one of several preprogrammed modes of operation which predesignate which coin receptacles 251 are dedicated to which coin denominations. Further, the operator can designate (or choose a predetermined designation) the number of coins directed into each individual coin receptacles 251. The number of coins directed into each coin receptacle 251 can correspond to a number which is useful to the operator such as a "hopper fill bag" number. Alternatively, the operator may wish to process as many coins as possible between unloadings and instruct the machine to direct the maximum number of coins into a coin receptacle 251 which the receptacle 251 can physically hold.

The columns 252*a–f* have rollers 167 attached thereto allowing each individual column to easily slide out of the rear of the currency processing machine 10 allowing an operator to empty the coin receptacles 251. In other alternative embodiments, the each individual column slides out of the front of the currency processing machine 10. In the illustrated embodiment of the columns 252*a–f*, each of the individual coin receptacles 251 are designed to allow rectangular coin bins (not shown) to fit within the individual coin receptacles 251. Accordingly, once a column 252 has been pulled out from the machine by an operator, the bins can be individually removed from the coin receptacle 251 to dump the coins therein into a larger coin receptacle. Alternatively, each of the coin receptacles 251 can be designed to hold coins. Because of the weight associated with bulk coins, each of the columns are separable into two sections each having five coin receptacles 251, thus giving an operator a more manageable weight with which to deal. For example, in FIG. 13*b* the column 252*a* comprises two sections 257*a* and 257*b*. Each of the sections 257*a,b* can be moved allowing an operator to dump the coins within the coin receptacles 251 into a larger coin receptacle. Alternatively, the operator can remove an entire column having coin receptacles 251 filled with coins and insert columns having empty coin receptacles 251.

Figure 14B:
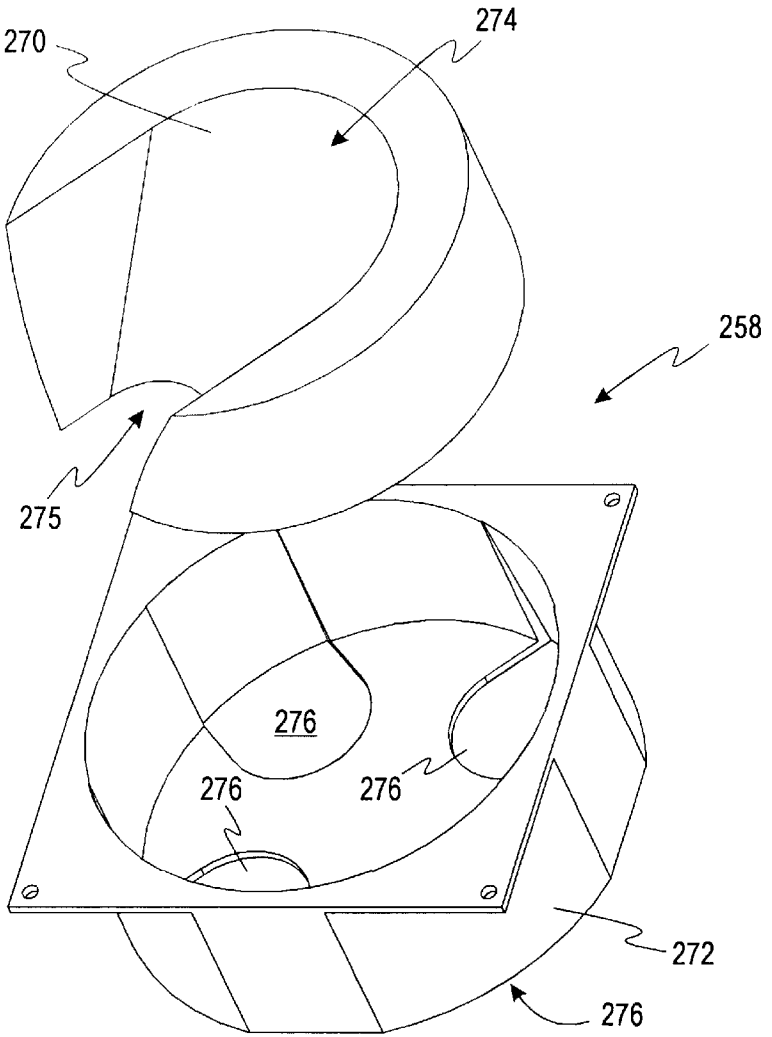
FIG. 14*b* is an exploded view of a rotating coin distribution manifold for a currency processing machine according to an embodiment of the present invention.
Figure 14A:
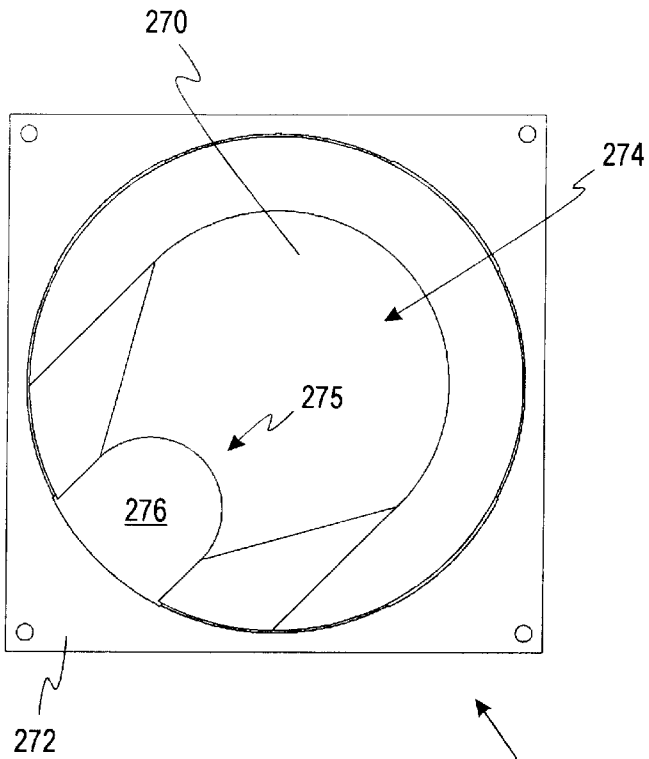
FIG. 14*a* is a top view of a rotating coin distribution manifold for a currency processing machine according to an embodiment of the present invention

FIGS. 14*a* and 14*b* describe the rotating distribution manifolds 258*a–d* in greater detail. Each rotating distribution manifold 258 contains a coin chute 270 which pivots within a stationary housing 272. The chute 270 is essentially a large cylinder with a groove disposed therein. The chute 270 has an inlet area 274 for receiving coins from an exit channel 254 via one or more coin tubes 256. The chute 270 has an outlet 275 which directs coins flowing down the chute 270, under the force of gravity, to one of four apertures 276 in the stationary housing 272. Each aperture 275 is coupled to a linear distribution manifold 260–265 via a tube 256. Rotation of the chute 270 among the four apertures 276 routes the coins to the different linear distribution manifolds 260–265. A suitable controller (not shown) is electrically coupled to the coin chute 270 for rotating the coin chute 270 among the four apertures 276.

Figure 15:
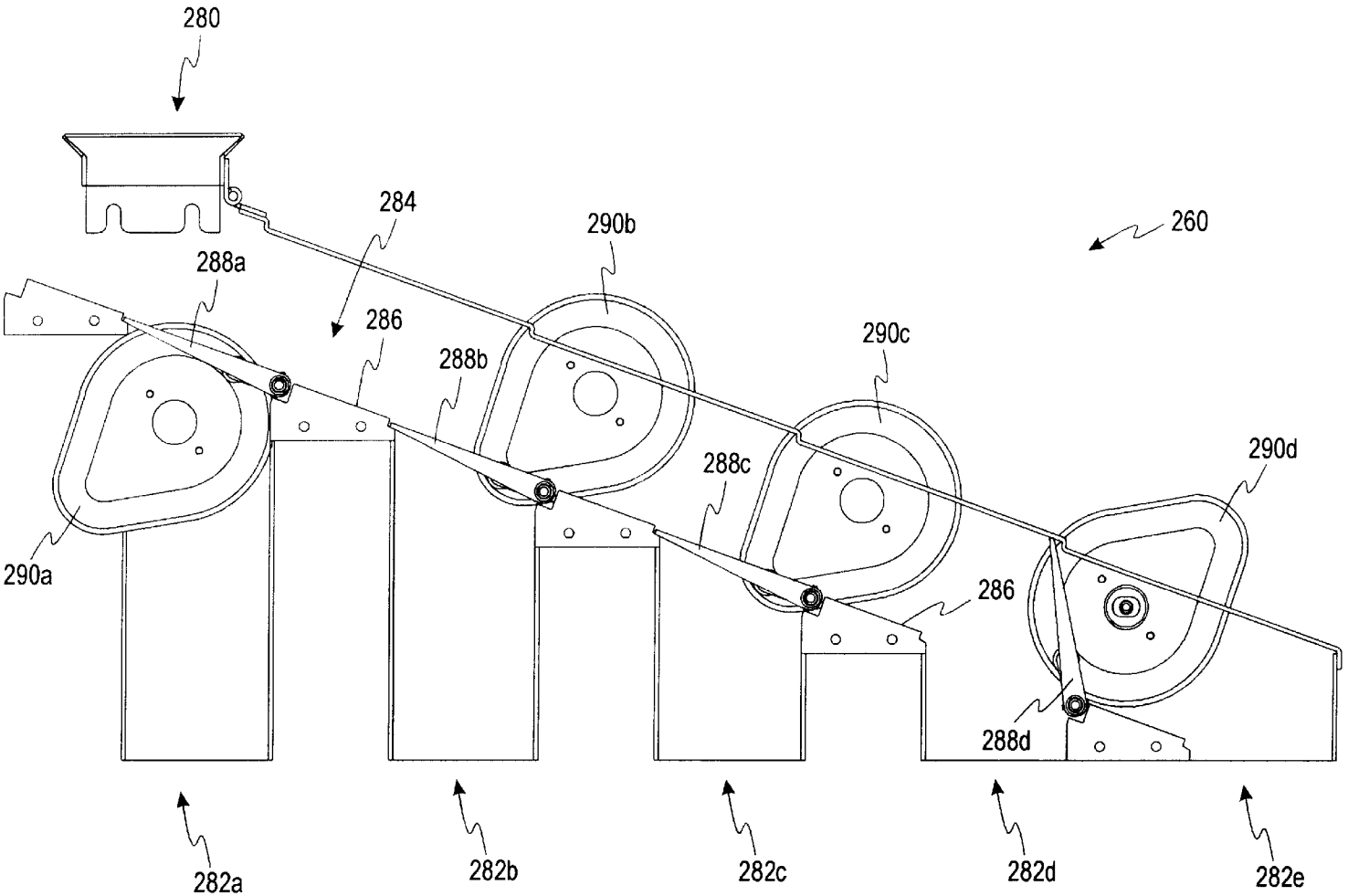
FIG. 15 is a side view of a linear coin distribution manifold for a currency processing machine according to an embodiment of the present invention.

Referring to FIG. 15, the linear distribution manifold 260 will be described in greater detail. Each of the linear distribution manifolds 260–265 contains an inlet 280 and a plurality of outlets 282. In the illustrated embodiment, the linear distribution manifold 260 has five outlets 282*a–e*. The linear distribution manifold 260 has a downwardly slopping main coin passage 284 having a floor 286 with a plurality of gates 288 disposed therein. The number of gates 288 in any of the linear coin distribution manifolds 260–265 is one less than the total number of outlets 282. For example, the illustrated linear coin distribution manifold 260 has five outlets 282*a–e* and therefore, has four gates 288*a–d* disposed therein. Each gate 288 is hingedly coupled to the floor 286. A cam 290 is coupled to each of the gates 288 for moving each of the gates 288 between the open and the closed position. In alternative embodiments of the present invention, individual motors are used to actuate each of the gates 288*a–d*. Viewing FIG. 15 from left to right, the first three gates 288*a–c* are illustrated in the closed position while the forth gate 288*d* is illustrated in the open. Such an arrangement would cause coins flowing into the linear distribution manifold 260 through inlet 280 to flow through outlet 282*d* and into the corresponding coin receptacle 251 disposed below. A suitable controller (not shown) is coupled to the linear distribution manifold 260–265 for individually moving each of the gates 288 between the open and the closed positions.

Figure 16:
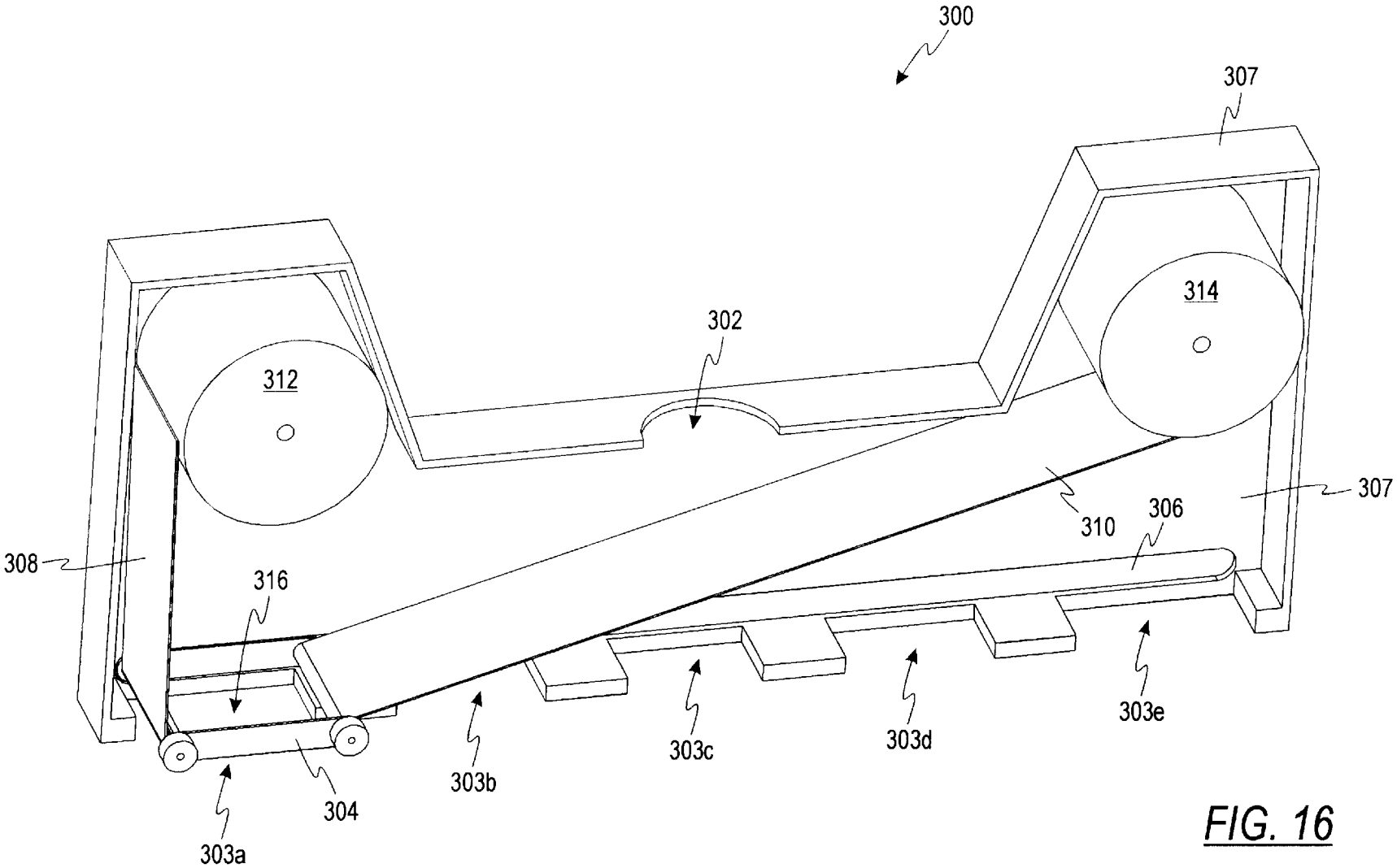
FIG. 16 is a perspective view of an alternative embodiment of a linear coin distribution manifold for a currency processing machine according to an embodiment of the present invention.
Figure 17:
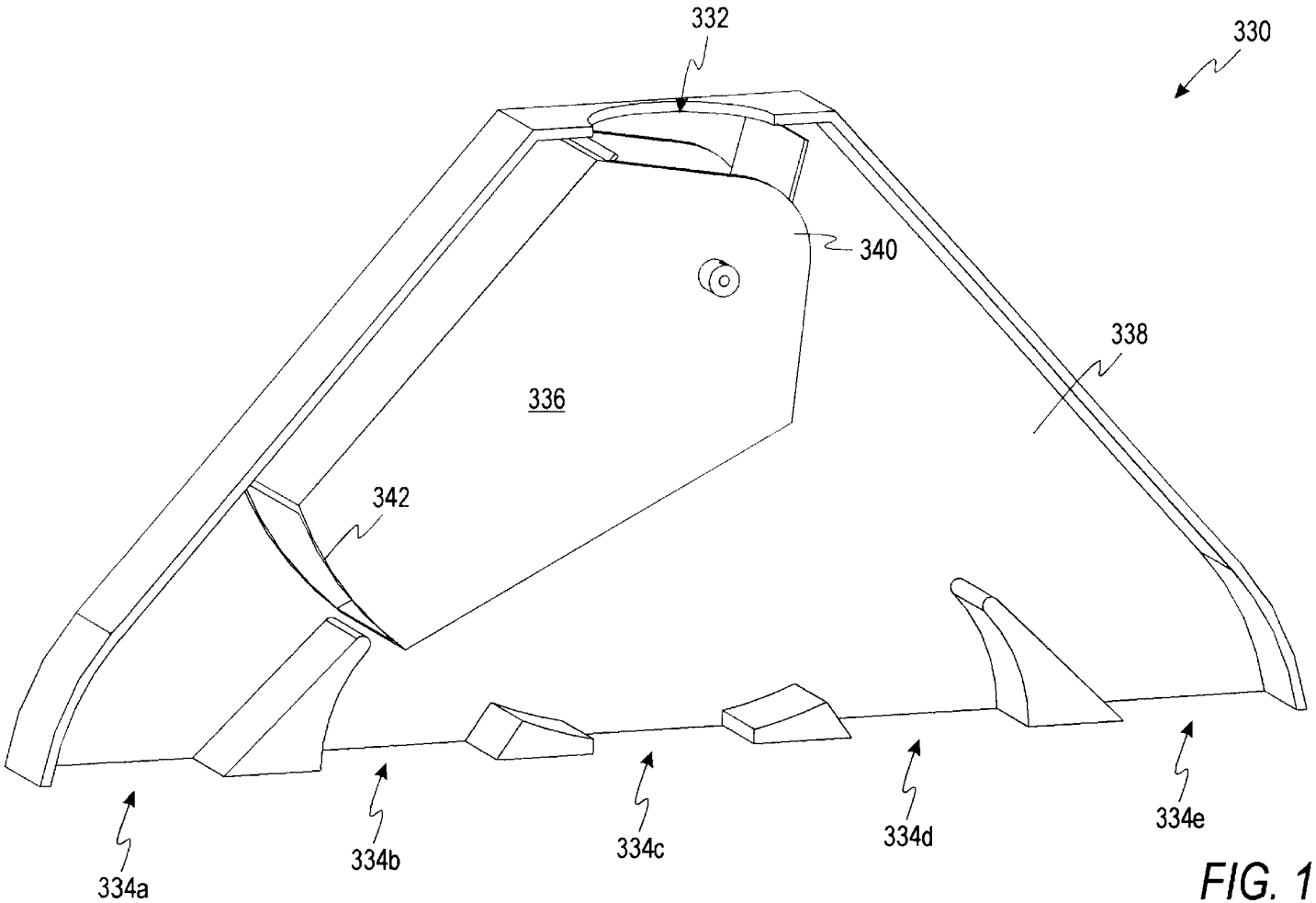
FIG. 17 is a perspective view of another alternative embodiment of a linear coin distribution manifold for a currency processing machine according to an embodiment of the present invention.
Figure 18:
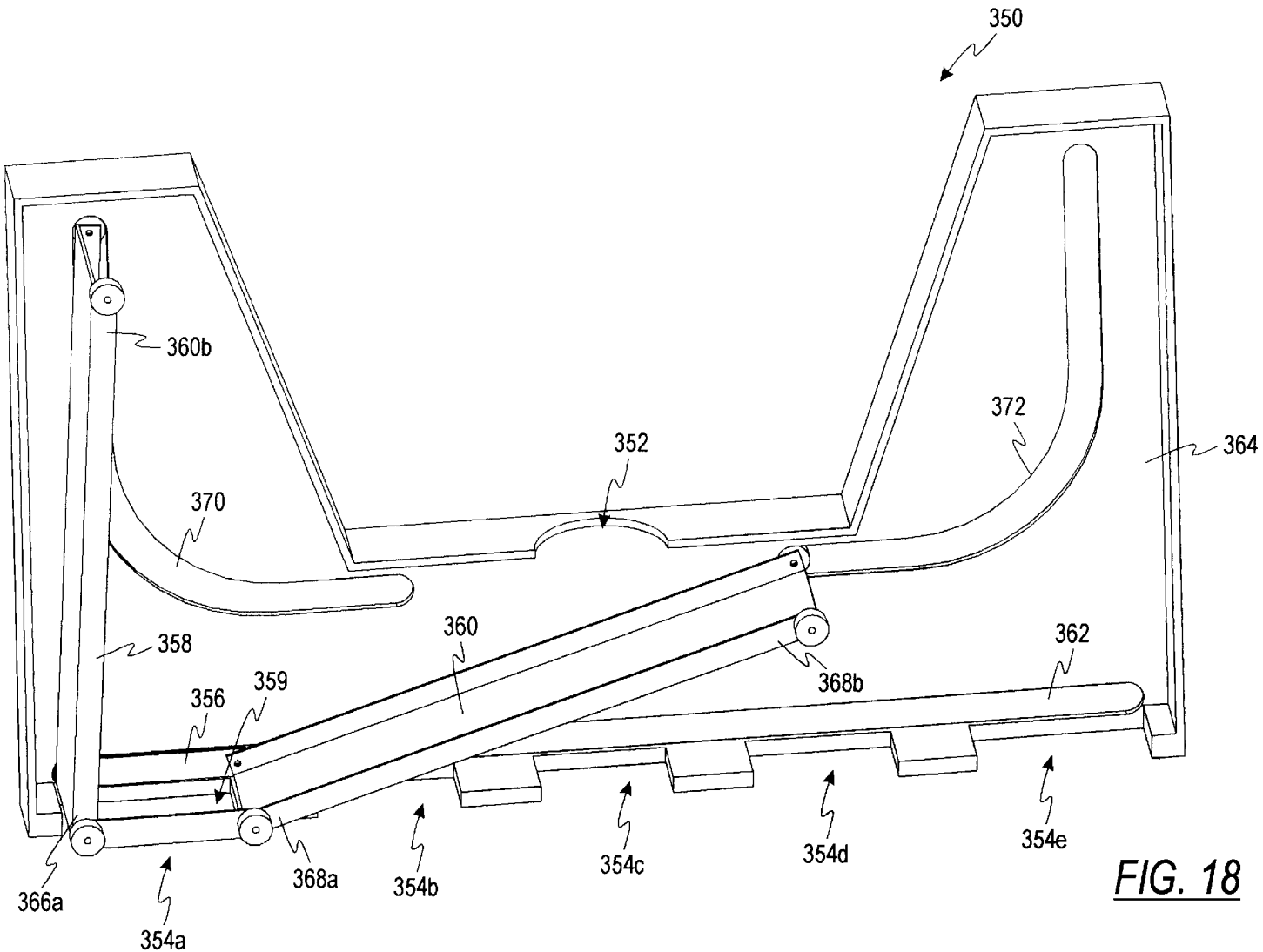
FIG. 18 is a perspective view of another alternative embodiment of a linear coin distribution manifold for a currency processing machine according to an embodiment of the present invention.

FIGS. 16, 17, and 18 illustrate alternative embodiments of the linear distribution manifold 260. Referring now to FIG. 16, a linear distribution manifold 300 contains an inlet 302 and a plurality of outlets 303*a–e* which are each disposed above corresponding coin receptacles 251. A cart 304 slides along a track 306 disposed in the housing 307 of the linear distribution manifold 300. Movement is provided to the cart 304 by two belts 308, 310 the first ends of which are coupled to the cart 304. The second end of each of the belts is coupled to rollers 312, 314. Rotation of the rollers 312, 314 causes the cart 304 to be pulled along the track 306. The cart 304 contains an aperture 316 to allow coins to pass through the cart 304.

In operation, the rollers 312, 314 are rotated to position the aperture 316 of the cart 304 over one of the outlets 303. Coins are directed to the inlet 302 by a tube 256. Coins pass through the inlet 302 onto one of the belts 308, 310 disposed below the opening. The downward slope of the belts 308, 310 causes coins to travel toward the cart 304 and through the aperture 316 into the corresponding coin receptacles 251 disposed below the linear distribution mechanism 300. Specifically, when the cart 304 is positioned over the left-most outlets 303*a,b*, the right-most belt 310 directs coins to the outlets 303*a,b*. And when the cart 304 is positioned over the right-most outlets 303*d,e*, the leftmost belt 308 directs coins to the outlets 303*d,e*.

Referring now to FIG. 17, another alternative embodiment of a linear distribution manifold 330 is illustrated. The linear distribution manifold 330 has an inlet 332 and a plurality of outlets 334*a–e* which are disposed above corresponding coin receptacles 251 (FIG. 13*a*). The manifold 300 contains a chute 336 pivotally attached to a housing 338 of the manifold 300 at a first end 340 disposed near the inlet 332. A second end 342 of the chute is disposed adjacent the outlets 334*a–e*. The chute pivots so that coins entering the chute at the first end 340 from the inlet 332 can be directed to any one of the outlets 334*a–e*.

Referring now to FIG. 18, another alternative embodiment of a linear distribution manifold 350 is illustrated. The linear distribution manifold 350 has an inlet 352 and five outlets 354*a–e* which are disposed above the coin receptacles 251 (FIG. 13*a*). The manifold 350 contains a cart 356 disposed between two movable ramps 358, 360 which channel coins flowing through the inlet 352 to one of the outlets 354*a–e*. The cart 356, which has an aperture 359 disposed therein, essentially acts as a gate which only provides access to one of the outlets 354*a–e* at any given time. The cart 356 is slidably engaged to a track 362 which is disposed in a housing 364 of the manifold 350 allowing the cart to be movable in the horizontal direction within the manifold 350. Each of the ramps 358,360 have a first end 366*a*, 368*a* which is coupled to the cart 356 and a second end 366*b*, 368*b* which is slideably engaged to tracks 370, 372, respectively, disposed within housing 364. The ramps 358, 360 are designed to move along with the cart 356. The cart 356 has an aperture 359 disposed therein permitting coins flowing down the ramp 358, 360 to pass through the cart 356 and into one of the coin receptacles 251.

In the operation of the linear coin manifold 350 illustrated in FIG. 18, coins are directed to the inlet 352 via a coin tube 256. Coins flowing through the inlet 352 contact ramp 360 and are directed downward towards the cart 356 disposed over outlet 354*a*.

Once the coin receptacle 251 disposed below outlet 354*a* is filled, the cart 356 is moved and positioned over the adjacent outlet 354*b*, for example. Movement of the cart 356 causes the ramps 358, 360 to shift thus directing coins flowing through the inlet 352 to the outlet 354*b* over which the cart 256 is positioned. Specifically, when the cart 356 is positioned over the left-most outlets 354*a,b*, the right-most ramp 360 directs coins to the outlets 354*a,b*. And when the cart 356 is positioned over the left-most outlets 354*d,e*, the right-most ramp 358 directs coins to the outlets 354*d,e*.

Figure 19:
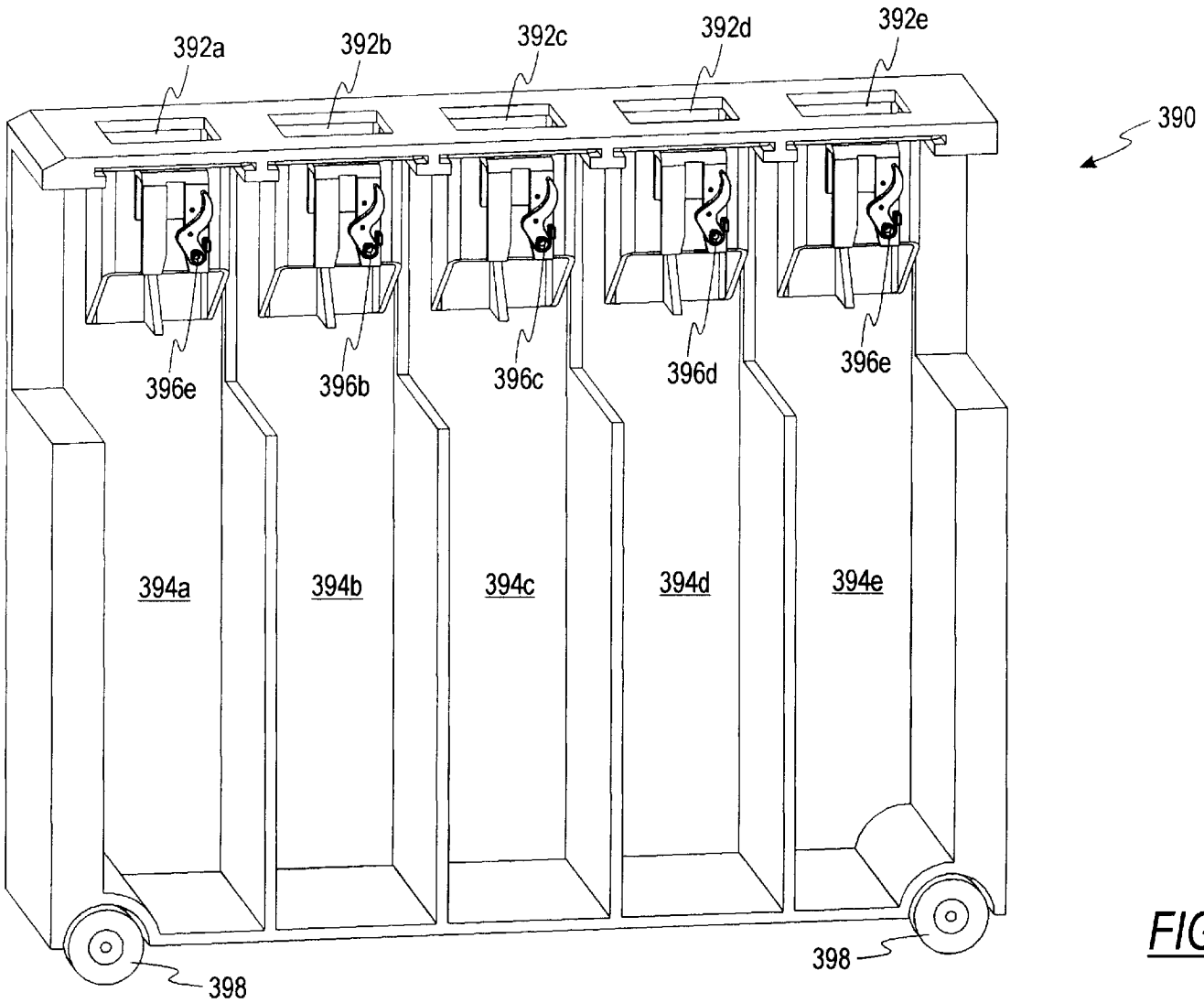
FIG. 19 is perspective view of a section of an alternative embodiment of a column of coin receptacles for a currency processing machine according to an embodiment of the present invention.

Referring now to FIG. 19, an alternative embodiment of a five receptacle section 390 of a coin receptacle column 252 is illustrated. The section 390 contains five inlets 392*a–e* corresponding to the five coin collection areas 394*a–e*. Each coin collection area 394 contains a bag clip 396 for holding a coin bags (not shown) in the coin collection area 394. The section 390 is equipped with rollers 398 allowing the unit to easily slide into and out of the currency handing machine 10.

One disadvantage of prior art currency processing machines is the large amount of downtime associated with the physical removal of coins from the machine during which the machine is essentially out of service. When the coin receptacles of a currency processing machine become full, an operator must physically remove the coins from the currency processing machine. In typical currency processing machines, the machine is unable to transact with a user while the operator is unloading the machine because the coin receptacles may not be properly positioned within the machine or the addition of new coins compromises the integrity of the count (aggregate value, number of coins, etc.) of the batch of coins being unloaded. The problem is further exasperated by some prior art machines which implement a single coin convey track to deliver coins both to the user and the operator of the machine. It may be necessary to route coins to a user in certain instances such as when the user is changing paper currency or is due change from a particular transaction. When the coin convey track is busy delivering coins to an operator, the machine in unable to transact with a user. The alternative embodiments of the coin distribution network for use in conjunction with the currency processing machine 10 (FIG. 1) which are illustrated in FIGS. 20–22 are directed at eliminating the aforementioned downtime associated with some prior art currency processing machines.

Figure 20:
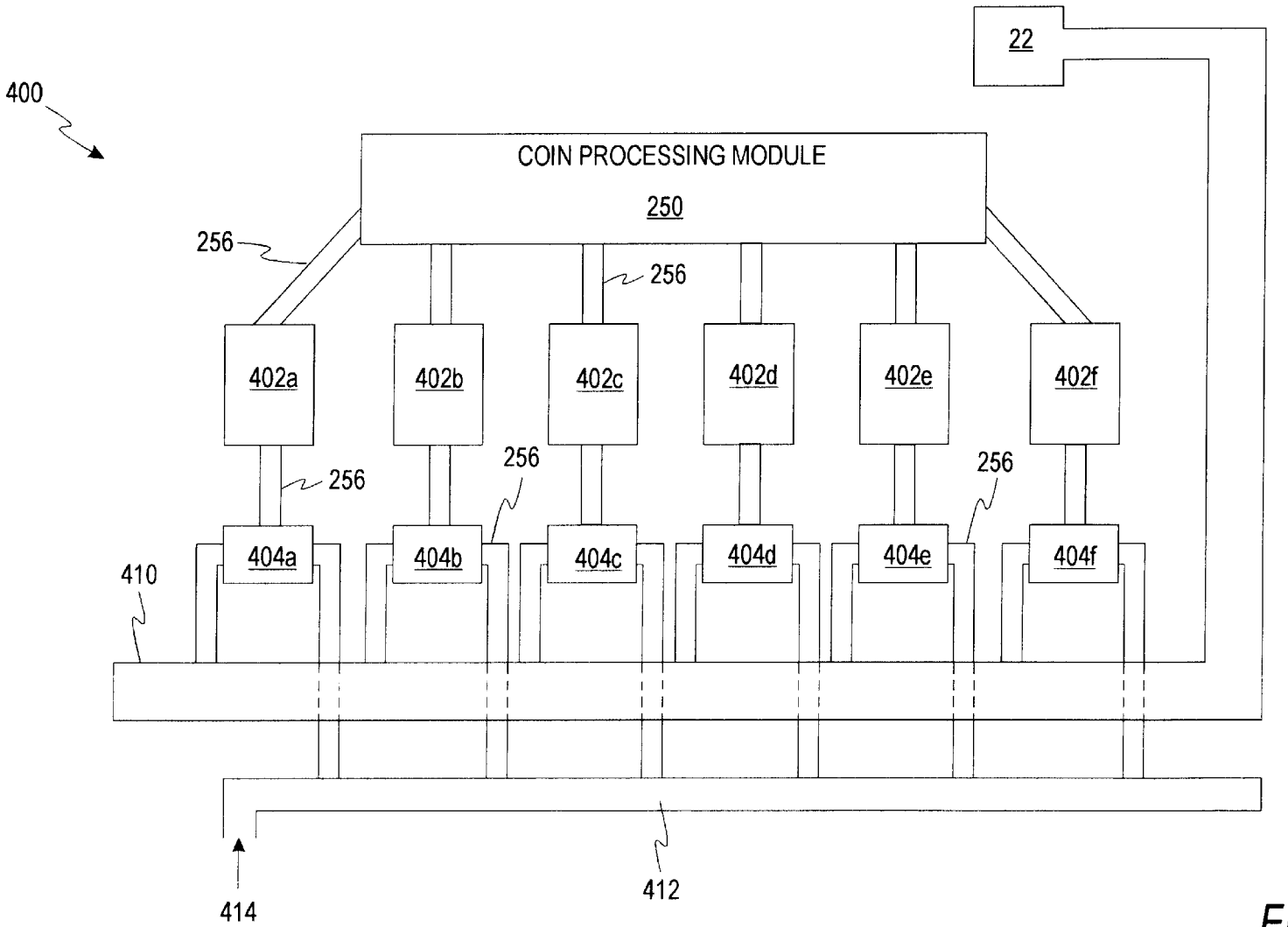
FIG. 20 is a schematic drawing of an alternative embodiment of a coin distribution network for a currency processing machine according to an embodiment of the present invention.
Figure 21:
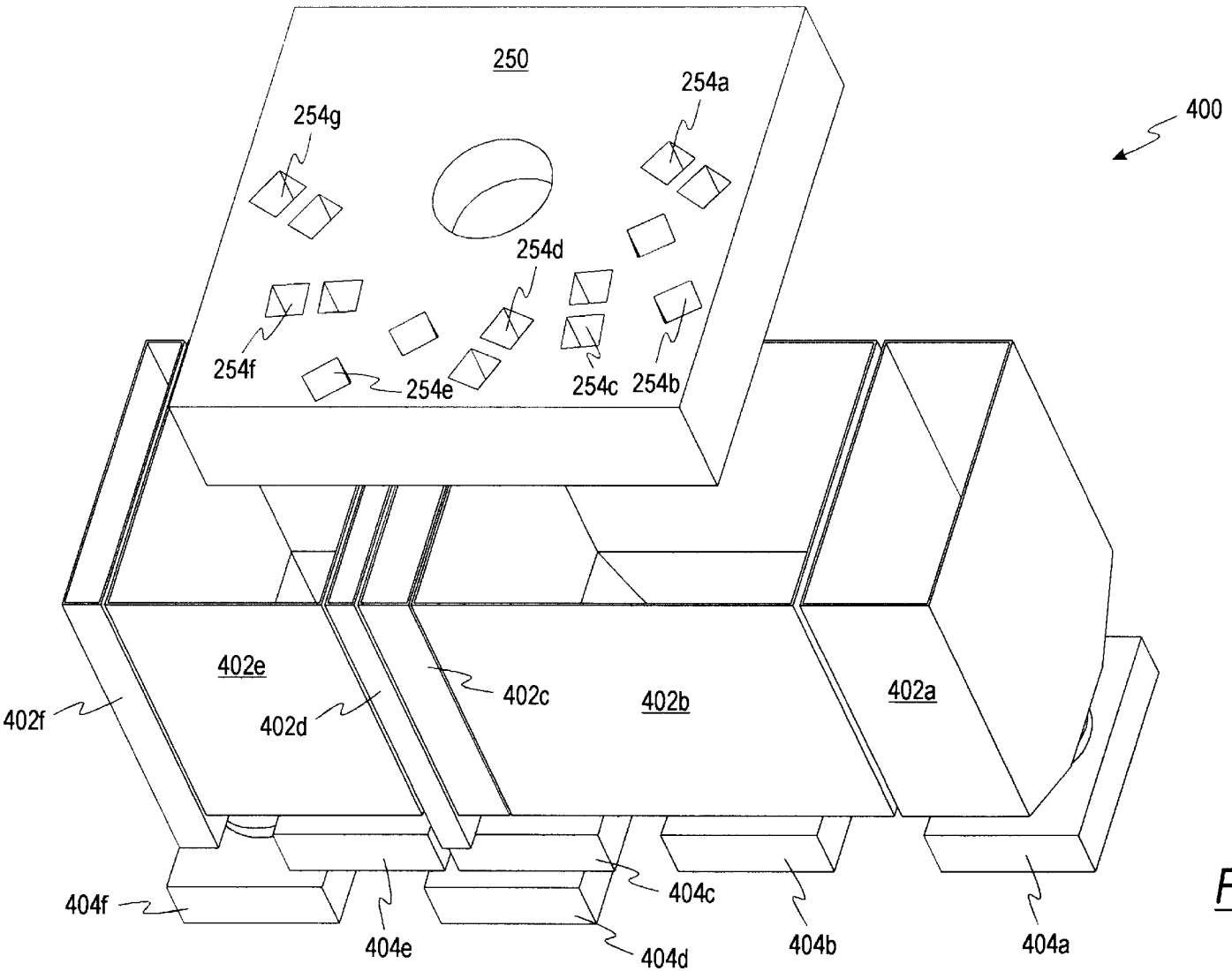
FIG. 21 is rear perspective view of an alternative embodiment of a coin distribution network for a currency processing machine according to an embodiment of the present invention.

FIG. 20 illustrates a schematic of an alternative embodiment of a coin distribution network 400 having a plurality of intermediate coin bins 402*a–f* which can be used in conjunction in the currency processing machine 10 illustrated in FIG. 1. The plurality of intermediate coin bins 402*a–f* are disposed below the coin processing module 250. Coins counted and sorted into individual denominations are routed via tubes 256 (such as those illustrated in FIG. 13*a*) from the exit channels of the coin processing module 250 into one of the plurality of intermediate coin bins 402*a–f* The coin processing module 250 initially counts the coins to determine the aggregate value of the coins deposited by an individual user for purposes of that particular transaction. Further, the coin processing module 250 can keep track of the coin totals (value, number of coins, etc.) over a given time interval for quality control purposes. Each intermediate coin bin 402 receives and holds a single coin denomination. A coin counter 404 is associated with each intermediate coin bin 402. Each coin counter 404 is disposed below each respective intermediate coin bin 402 for counting each coin dispensed from the intermediate coin bin 402. The coin distribution network 400 has two convey paths, a user convey path 410 and a operator convey path 412, which transport coins from the counters 404 to the user and the operator, respectively.

The coin distribution network 400 eliminates the aforementioned downtime associated with unloading coins from the currency processing machine 10. The downtime is eliminated because the intermediate coin bins 402 are able to receive coins while dispensing coins to the convey paths 410, 412. The counters 404 only count those coins which are dispensed to the convey paths 410, 412. Accordingly, new coins directed into the intermediate coins bins 402 will not affect the batch values for the coins being dispensed to the convey paths 410, 412. For example, while coins are being transported to an operator via the operator convey path 412, the counters 404 are separately counting the coins dispensed to the operator convey path 410 and to the user convey path 412. Appropriate value totals are maintained for the coins transported to the operator. Additionally, the coin distribution network 400 is able to dispense coins back to a user via the user convey path 410 while coins are also being transported to an operator via operator convey path 412.

In the illustrated embodiment of the coin distribution network 400, the user convey path 410 transports coins to a user via the dispensed coin receptacle 22 (also shown in FIGS. 1 and 2). Alternatively, the user covey path 410 transports coins directly to the coin dispensing module 36 (FIG. 2) to maintain the inventory of coins within the coin dispensing module. The operator convey path 412 transports coins to the operator via an outlet 414 such as a coin spout. The operator may collect coins flowing through the spout 114 with anyone of a number of coin receptacles such as rigid coin bins or coin bags. In various alternative embodiments, the number of coins transported to the operator can be varied. For example, in one embodiment, the second convey path delivers the entire contents of an intermediate coin bin 402 to the outlet. In another alternative embodiment, delivery of coins to the outlet 414 by the operator convey path 412 is suspended after a predetermined number of coins (e.g. corresponding to a "hopper fill bag") are delivered to the outlet 414. The operator convey path 412 resumes operation after a momentary pause allowing the operator to switch coin receptacles or their switch of coin receptacles is automated. Alternatively, operation is resumed after the machine 10 receives input from the operator. In other alternative embodiments, the coin counters simultaneously route coins to both the user and the operator convey paths 410, 412 allowing the currency handing machine 10 to deliver coins to a user via the user convey path 410 and to an operator via the operator convey path 412. The counters 404 separately count those coins which are distributed to the user convey path 410 and the operator convey path 412. In still another alternative embodiment of the currency processing machine 10, a plurality of tubes 256 coupled to each of the counters 404 channel coins directly to a plurality of coin spouts. Each of the plurality of coin spouts corresponding to an individual coin denomination.

Referring now to FIG. 21, a physical embodiment of the coin distribution network 400 (illustrated in FIG. 20) which may be implemented in the currency processing machine 10 is illustrated. The sorted coins are routed from the exit channels 254*b–g* via tubes 256 (not shown) to the intermediate coin bins 402. The aforementioned undesirable coins are off-sorted via exit channel 254*a* to an off-sort area (not shown). In one embodiment of the coin distribution network, the user convey path 410 and the operator convey path 412 transport coins to a user and an operator, respectively. In an alternative embodiment of the coin distribution network 400, a network of coin tubes 256, rotating coin distribution manifolds 258*a–d*, linear coin distribution manifolds 260–265, and coin receptacles 251, such as illustrated in FIG. 13*a*, are used in conjunction with the coin distribution network 400 illustrated in FIG. 20. Such an embodiment would allow the currency machine to continuously operate with no downtime associated with removing coins from the currency processing machine 10 because only those coins dispensed from the intermediate coins bins 402 and directed into the coin receptacles 251 would be counted by the counters 404 and included in the batch totals for those coins unloaded from the currency processing machine 10. The intermediate coin bins 402 are able to receive coins while dispensing coins.

Figure 22A:
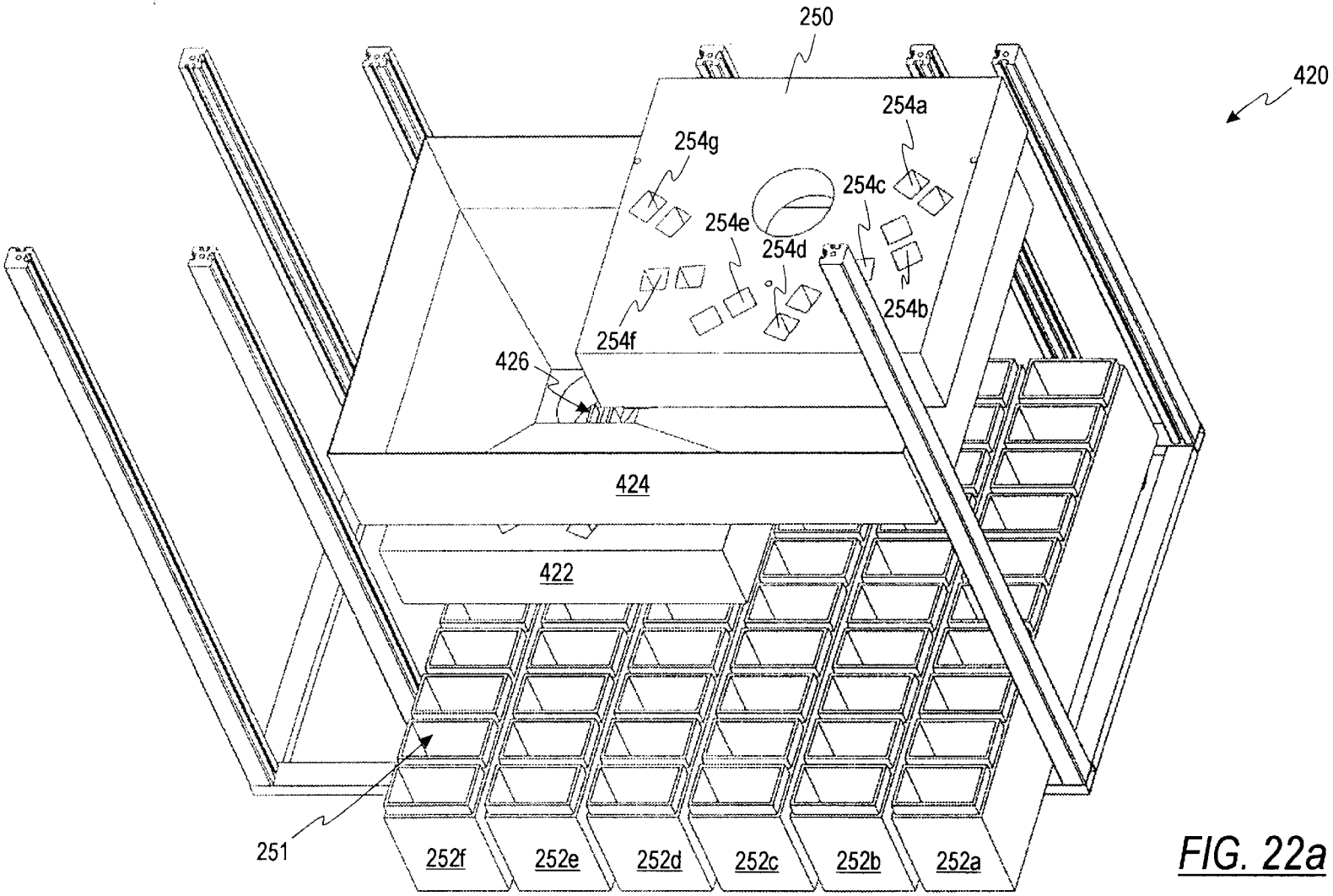
FIG. 22*a* is rear perspective view of another alternative embodiment of a coin distribution network for a currency processing machine according to an embodiment of the present invention.
Figure 22B:
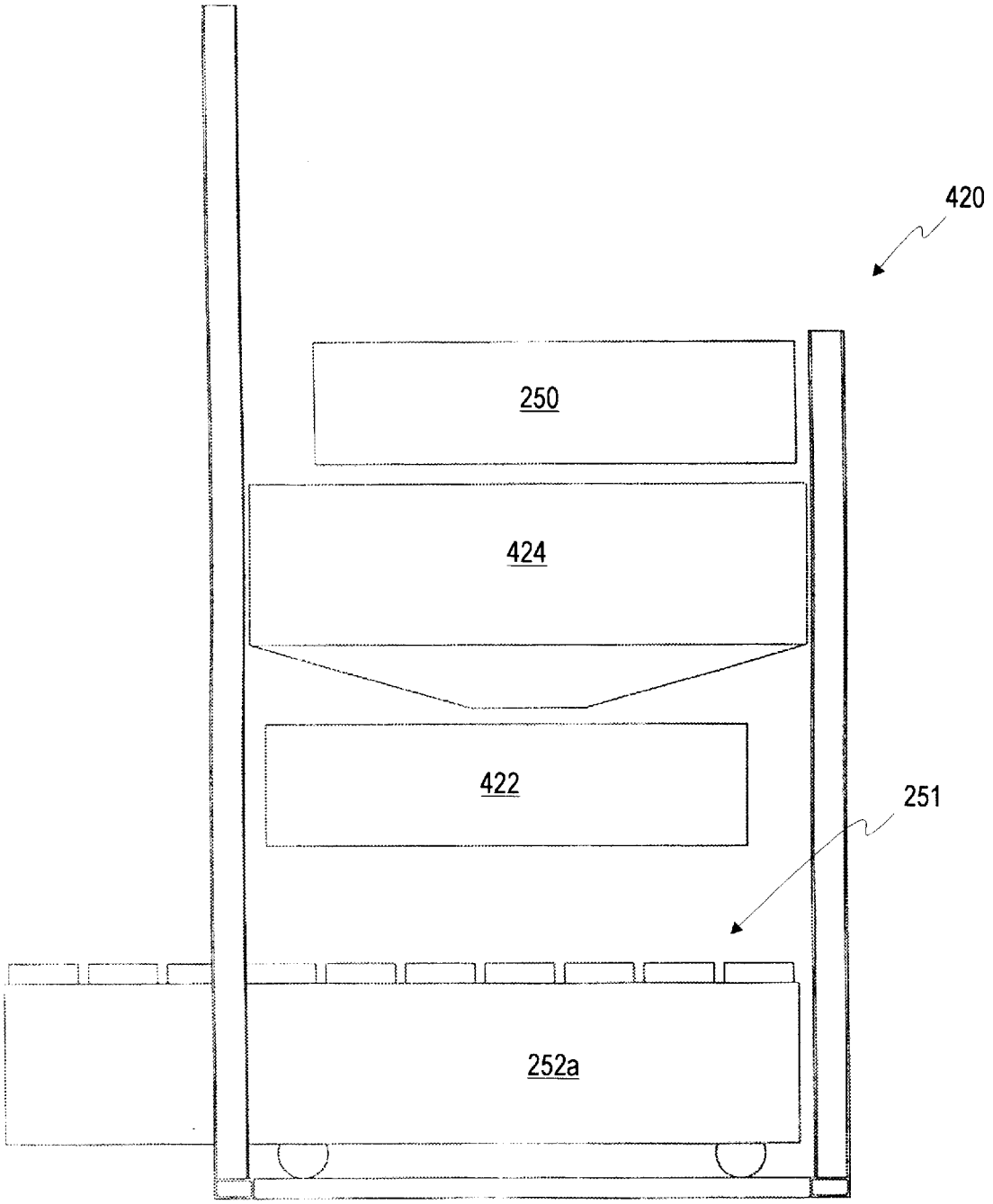
FIG. 22*b* is side view of another alternative embodiment of a coin distribution network for a currency processing machine according to an embodiment of the present invention.

Referring now to FIGS. 22*a* and 22*b*, an alternative embodiment of a coin distribution network 420 implementing a first coin processing module 250 and a second coin processing module 422 is illustrated. This embodiment also eliminates the aforementioned downtime associated with removing coins from the currency processing machine 10. Coins are first counted and sorted by the first coin processing module 250 to determine the value of the coins input to the currency processing machine 10 by a user. The exit channels 254*b–*254*g* essentially dump into a coin holding area 424 while the exit channel 254*a* is reserved for undesirable coins. Coins are then routed to the second coin processing module 422 via an outlet 426 where the coins are sorted and recounted. The coins exiting the exit channels (not shown) of the second coin processing module 422 are then distributed into a plurality of coin receptacles 251 disposed below the coin handing device. In one embodiment, a combination of coin tubes 256, rotating coin distribution manifolds 258, and linear coin distribution manifolds 260–265 such as those illustrated in FIG. 13 a may be used to route coins into the plurality of coin receptacles 251. The embodiment of the coin distribution network 420 illustrated in FIGS. 22*a* and 22*b* alleviates the aforementioned downtime associated with an operator removing processed coins from the currency processing machine 10. The coin holding area 424 can hold coins received from a user while an operator unloads the coins. In an alternative embodiment of the coin distribution 420 having a first and a second coin processing modules 250, 422, the two coin convey paths 410, 412 shown in FIGS. 20 and 21 are used to route coins to a user and an operator. In still another alternative embodiment of the currency processing machine 10, a plurality of tubes 256 coupled to each of the exit channels of the second coin processing module 422 channel coins directly to a plurality of coin spouts. Each of the plurality of coin spouts corresponding to an individual coin denomination.

While the present invention has been described with reference to one or more preferred embodiments, those skilled in the art will recognize that many changes may be made thereto without departing from the spirit and scope of the present invention. For example, this invention related to selectively distributing coins can be employed on machines which receive only coins, not bank notes, and provides the user with redemption for those deposited coins.

What is claimed is:

1. A currency processing machine in which a user deposits coins of mixed denominations, comprising:

a hopper for receiving the coins of mixed denominations;

a sorting device for sorting the mixed coins into denominations;

a coin receptacle station for each denomination that receives the sorted coins, each coin receptacle station including a plurality of coin receptacles for holding the sorted coins and a coin distribution mechanism for selectively distributing the sorted coins between the plurality of coin receptacles in response to an external signal from a host system, the coin receptacles of the coin receptacle station being disposed in a plurality of columns, each column having a plurality of rows;

means for determining the amount of the deposited coins; and means for converting the deposited coins into alternative funds available to the user.

2. The currency processing machine of claim 1 wherein the coin distribution mechanism includes a plurality of rotating distribution manifolds coupled to the sorting device for selectively distributing the sorted coins to at least one of the plurality of columns of coin receptacles.

3. The currency processing machine of claim 2 wherein each of the plurality of rotating distribution manifolds contains a pivotal coin chute.

4. The currency processing machine of claim 2 wherein the coin distribution mechanism further includes a plurality of linear distribution manifolds, at least one of the plurality of linear distribution manifolds being coupled to one of the plurality of the rotating distribution manifolds.

5. The currency processing machine of claim 4 wherein each of the plurality of linear distribution manifolds includes a plurality of gates, each of the plurality of gates being adapted to direct coins to a corresponding one of the plurality of coin receptacles.

6. The currency processing machine of claim 4 wherein at least one linear distribution manifold is disposed above each column of coin receptacles, each linear distribution manifold being adapted to selectively distribute sorted coins into one of the plurality of coin receptacles disposed below the respective linear distribution manifold.

7. A currency processing machine in which a user deposits funds including coins of mixed denominations and paper notes, comprising:

means for receiving and counting the paper notes;

a hopper for receiving the coins of mixed denominations;

a sorting device for sorting the mixed coins into denominations;

a coin receptacle station for each denomination that receives the sorted coins, each coin receptacle station including a plurality of coin receptacles for holding the sorted coins and a coin distribution mechanism for selectively distributing the sorted coins between the plurality of coin receptacles, the coin receptacles of the coin receptacle station being disposed in a plurality of columns, each column having a plurality of rows; and means for determining the amount of the deposited funds.

8. The currency processing machine of claim 7 wherein the coin distribution mechanism includes a plurality of rotating distribution manifolds coupled to the sorting device for selectively distributing the sorted coins to at least one of the plurality of columns of coin receptacles.

9. The currency processing machine of claim 8 wherein each of the plurality of rotating distribution manifolds contains a pivotal coin chute.

10. The currency processing machine of claim 8 wherein the coin distribution mechanism further includes a plurality of linear distribution manifolds, at least one of the plurality of linear distribution manifolds being coupled to one of the plurality of the rotating distribution manifolds.

11. The currency processing machine of claim 10 wherein each of the plurality of linear distribution manifolds includes a plurality of gates, each of the plurality of gates being adapted to direct coins to a corresponding one of the plurality of coin receptacles.

12. The currency processing machine of claim 10 wherein at least one linear distribution manifold is disposed above each column of coin receptacles, each linear distribution manifold being adapted to selectively distribute sorted coins into one of the plurality of coin receptacles disposed below the respective linear distribution manifold.

13. A currency processing machine in which a user deposits funds including currency bills and coins of a plurality of denominations, the currency processing machine comprising:

means for receiving and counting the currency bills;

a plurality of coin receptacles for holding coins, a first set of the plurality of coin receptacles being associated with a first coin denomination, a second set of the plurality of coin receptacles being associated with a second coin denomination;

an input hopper being adapted to receive the coins of a plurality of denominations;

a sorting device coupled to the input hopper, the sorting device being adapted to sort the coins into denominations and to discharge coins out of a plurality of exit channels, each exit channel corresponding to one of the plurality of coin denominations;

at least one rotating distribution manifold coupled to the exit channels for selectively distributing the sorted coins between the first set of the plurality of coin receptacles and the second set of the plurality of coin receptacles; and a plurality of linear distribution manifolds, at least one of the plurality of linear distribution manifolds being coupled to one of the at least one rotating distribution manifolds, the at least one linear coin distribution manifold being disposed above and being adapted to selectively distribute sorted coins to coin receptacles within the first set.

14. The currency processing machine of claim 13 wherein the at least one rotating distribution manifold contains a pivotal coin chute.

15. The currency processing machine of claim 14 wherein the at least one rotating distribution manifold is a generally hollow cylinder having a top surface and a bottom surface, the rotating distribution manifold having an inlet disposed in the upper surface and a plurality of outlets disposed generally towards an outer periphery of the bottom surface, the pivotal coin chute being adapted to receive the coins from the inlet and to selectively distribute the coins, under the force of gravity, to one of the plurality of outlets.

16. The currency processing machine of claim 15 further comprising a controller being adapted to pivot the pivotal coin chute among the plurality of outlets.

17. The currency processing machine of claim 13 wherein each of the plurality of linear distribution manifolds includes a plurality of gates, each of the plurality of gates being adapted to direct coins to a corresponding one of the plurality of coin receptacles.

18. The currency processing machine of claim 13 wherein each of the linear distribution manifolds include an inlet, a plurality of outlets, and a plurality of gates being movable between an open position and a closed position, each of the plurality of gates in the open position being adapted to direct coins through a downwardly adjacent outlet to a corresponding one of the plurality of coin receptacles.

19. The currency processing machine of claim 18 wherein each of the linear distribution mechanisms further comprise:

a sensor being adapted to count the number of coins directed to each of the outlets, the sensor being adapted to produce a signal when a predetermined number of coins have been directed to one of the plurality of outlets; and a controller being adapted to receive the signal from the sensor, the controller being adapted to individually move each of the plurality of gates from the closed to the open position upon receipt of the signal.

20. The currency processing machine of claim 13 wherein the first set of the plurality of coin receptacles are disposed within a column of coin receptacles.

21. The currency processing machine of claim 13 wherein the second set of the plurality of coin receptacles are disposed with a column of coin receptacles.

22. The currency processing machine of claim 21 wherein the column of coin receptacles has a plurality of rollers attached thereto.

23. The currency processing machine of claim 13 wherein each of the plurality of linear distribution mechanisms include a pivotal coin chute.

24. The currency processing machine of claim 13 wherein each of the plurality of linear distribution mechanisms include a movable belt directing coins to a cart, the cart being adapted to one of the plurality of coin receptacles.

25. The currency processing machine of claim 13 wherein each of the plurality of linear distribution mechanisms include a movable ramp directing coins to a cart, the cart being adapted to direct coins to one of the plurality of coin receptacles.

26. The currency processing machine of claim 13 wherein the plurality of exit channels includes at least four exit channels.

27. The currency processing machine of claim 13 wherein the plurality of exit channels includes seven exit channels.

28. The currency processing machine of claim 13 wherein the each of the plurality of coin receptacles includes a coin bag holder.

29. A currency processing machine in which a user deposits funds including coins of a plurality of denominations, the currency processing machine comprising:

an input hopper being adapted to receive the coins of a plurality of denominations;

a first coin processing unit coupled to the input hopper, the processing unit being adapted to determined the aggregate value of the coins received from the input hopper;

an intermediate coin receptacle being adapted to receive a plurality of denominations of coins from the first coin processing unit and to hold the plurality of coin denominations received from the coin processing unit, the intermediate coin receptacle having an outlet being adapted to selectively discharge coins; and a second coin processing unit coupled to the outlet of the intermediate coin receptacle, the second coin processing unit being adapted to sort the coins received from the intermediate coin receptacle and to discharge the coins out of a plurality of exit channels, each of the plurality of exit channels corresponding to a predetermined coin denomination to be processed, the second coin processing device being adapted to count the number of coins being discharged from each of the plurality of exit channels.

30. The currency processing machine of claim 29 wherein the first coin processing module comprises a coin sorter.

31. The currency processing machine of claim 29 further comprising:

a plurality of coin receptacles for holding coins, the plurality of coin receptacles being disposed in a plurality of columns, each column having a plurality of rows;

at least one rotating distribution manifold coupled to the exit channel of the second coin processing module for selectively distributing the sorted coins between at least two of the plurality of columns of coin receptacles; and a plurality of linear distribution manifolds, at least one of the plurality of linear distribution manifolds being coupled to the rotating distribution manifold, at least one linear distribution manifold being disposed above an associated column of coin receptacles, each of the linear distribution manifolds being adapted to selectively distribute sorted coins to each of the coin receptacles disposed below the linear distribution manifold in the associated column.

32. The currency processing machine of claim 31 wherein the at least one rotating coin distribution manifold contains a pivotal coin chute.

33. The currency processing machine of claim 32 wherein the at least one rotating distribution manifold is generally hollow cylinders having a top surface and a bottom surface, the rotating distribution manifold having an inlet disposed in the top surface and a plurality of outlets disposed generally towards an outer periphery of the bottom surface, the pivotal coin chute being adapted to receive the coins from the inlet and to selectively distribute the coins, under the force of gravity, to one of the plurality of outlets.

34. The currency processing machine of claim 31 wherein each of the plurality of linear distribution manifolds includes a plurality of gates, each of the plurality of gates being adapted to direct coins to a corresponding one of the plurality of coin receptacles.

35. The currency processing machine of claim 31 wherein each of the linear distribution manifolds further includes an inlet and a plurality of outlets, each of the plurality of gates being movable between an open position and a closed positioned, each of the plurality of gates in the open position being adapted to direct coins through a downwardly adjacent outlet towards a corresponding one of the plurality of coin receptacles.

36. The currency processing machine of claim 31 wherein each of the plurality of columns of coin receptacles has a plurality of rollers attached thereto.

37. The currency processing machine of claim 31 wherein each of the plurality of linear distribution mechanisms include a pivotal coin chute.

38. The currency processing machine of claim 31 wherein each of the plurality of linear distribution mechanisms include a movable belt directing coins to a cart, the cart being adapted to direct coins to one of the plurality of coin receptacles.

39. The currency processing machine of claim 31 wherein each of the plurality of linear distribution mechanisms include a movable ramp directing coins to a cart, the cart being adapted to direct coins to one of the plurality of coin receptacles.

40. The currency processing machine of claim 31 wherein the plurality of columns of coin receptacles includes at least three columns of coin receptacles, and the plurality of rows of coin receptacles includes at least five rows of coin receptacles.

41. The currency processing machine of claim 40 wherein the plurality of columns of coin receptacles includes six columns of coin receptacles, and the plurality of rows of coin receptacles includes ten rows of coin receptacles.

42. The currency processing machine of claim 31 wherein each of the plurality of coin receptacles includes a coin bag holder.

43. The currency processing machine of claim 29 further comprising:

a first coin convey track coupled to the coin exit channels, the coin first convey path being adapted to convey coins to a coin dispensing module; and a second coin convey track coupled to the coin exit channels, the second coin convey track being adapted to convey coins to a coin spout.

44. A currency processing machine in which a user deposits funds including coins of a plurality of denominations, the currency processing machine comprising:

an input hopper being adapted to receive the coins of a plurality of denominations;

a coin processing unit coupled to the input hopper, the coin processing unit being adapted to determine the aggregate value of the coins received from the input hopper, the coin processing unit being adapted to sort the coins received from the input hopper and to discharge the coins out of a plurality of exit channels, the plurality exit channels corresponding to the plurality of coin denominations to be processed;

a plurality of intermediate coin receptacles being adapted to receive coins from a corresponding one of the plurality of exit channels, each of the intermediate coin receptacles being adapted to hold coins received from the exit channels, each of the intermediate coin receptacles having an outlet being adapted to selectively distribute coins; and a plurality of counters being adapted to count the number coins discharged from each of the outlets of the intermediate coin receptacles.

45. The currency processing machine of claim 44 further comprising:

a plurality of coin receptacles for holding coins disposed below the plurality of intermediate coin receptacles, the plurality of coin receptacles being disposed in a plurality of columns, each column having a plurality of rows;

at least one rotating distribution manifold coupled to the outlet of one of the plurality of intermediate coin receptacles for selectively distributing the sorted coins between at least two of the plurality of columns of coin receptacles; and a plurality of linear distribution manifolds, at least one of the plurality of linear distribution manifolds being coupled to the rotating distribution manifold, at least one linear distribution manifold being disposed above an associated column of coin receptacles, each of the linear distribution manifolds being adapted to selectively distribute sorted coins to each of the coin receptacles disposed below the linear distribution manifold in the associated column.

46. The currency processing machine of claim 45 wherein the at least one rotating distribution manifold contains a pivotal coin chute.

47. The currency processing machine of claim 48 wherein the at least one of the rotating distribution manifold is a generally hollow cylinder having a top surface and a bottom surface, the rotating distribution manifold having an inlet disposed in the top surface and a plurality of outlets disposed generally towards an outer periphery of the bottom surface, the pivotal coin chute being adapted to receive the coins from the inlet and to selectively distribute the coins, under the force of gravity, to one of the plurality of outlets.

48. The currency processing machine of claim 45 wherein each of the plurality of linear coin distribution manifolds includes a plurality of gates, each of the plurality of gates being adapted to direct coins to a corresponding one of the plurality of coin receptacles.

49. The currency processing machine of claim 48 wherein each of the linear distribution manifolds further include an inlet and a plurality of outlets, the inlet being adapted to receive coins, each of the plurality of outlets being adapted to direct coins to a corresponding one of the plurality of coin receptacles, each of the plurality of gates being movable between an open position and a closed positioned, each of the plurality of gates in the open position being adapted to direct coins towards a downwardly adjacent outlet.

50. The currency processing machine of claim 45 wherein each of the plurality of columns of coin receptacles has a plurality of rollers attached thereto.

51. The currency processing machine of claim 45 wherein each of the plurality of linear distribution mechanisms include a pivotal coin chute.

52. The currency processing machine of claim 45 wherein each of the plurality of linear distribution mechanisms include a movable belt directing coins to a cart, the cart being adapted to direct coins to one of the plurality of coin receptacles.

53. The currency processing machine of claim 45 wherein each of the plurality of linear distribution mechanisms include a movable ramp directing coins to a cart, the cart being adapted to direct coins to one of the plurality of coin receptacles.

54. The currency processing machine of claim 45 wherein the plurality of columns of coin receptacles includes at least three columns of coin receptacles, and the plurality of rows of coin receptacles includes at least five rows of coin receptacles.

55. The currency processing machine of claim 54 wherein the plurality of columns of coin receptacles includes six columns of coin receptacles, and the plurality of rows of coin receptacles includes ten rows of coin receptacles.

56. The currency processing machine of claim 45 wherein each of the plurality of coin receptacles includes a coin bag holder.

57. The currency processing machine of claim 45 wherein each of the columns of coin receptacles is adapted to separate into at least two sections.

58. The currency processing machine of claim 44 further comprising:

a first coin convey track coupled to the coin exit channels, the coin first convey path being adapted to convey coins to a coin dispensing module; and a second coin convey track coupled to the coin exit channels, the second coin convey track being adapted to convey coins to a coin spout.

59. A method of processing coins with a currency processing machine, the method comprising:

receiving coins of mixed denominations with a hopper;

determining the aggregate value of the coins of mixed denominations received by the hopper with a first coin processing unit;

directing the coins to an intermediate coin receptacle;

selectively discharging the coins from the intermediate coin receptacle to a second coin processing unit; and sorting the coins into individual coin denominations with the second coin processing unit.

60. The method of claim 59 further comprising:

transporting coins from the plurality of coin exit channels to a coin dispensing module with a first coin convey path; and transporting coins from the plurality of the plurality of coin exit channels to a coin spout with a second coin convey path.

61. The method of claim 59 wherein the currency processing machine includes a plurality of coin receptacles for holding coins, the plurality of coin receptacles being arranged in at least a first column and a second column, each column having a plurality of coin receptacles, the method further comprising:

channeling at least one coin denomination from the second coin processing unit to a first distribution manifold;

distributing coins with the first distribution manifold between the first column and the second column;

channeling coins from the first distribution manifold to a second distribution manifold;

distributing the coins with the second distribution manifold to the coin receptacles within the first column.

62. The method of claim 61 wherein distributing coins with the first rotating distribution manifold further comprises rotating a pivotal coin chute.

63. The method of claim 61 wherein distributing coins with the second distribution manifold further comprises individually moving a plurality of gates between an open position and a closed position.

64. The method of claim 61 wherein distributing coins with the second distribution manifold further comprises counting the number of coins distributed into the coin receptacles within the first column.

65. The method of claim 59 wherein the currency processing machine includes a plurality of coin receptacles for holding coins, the plurality of coin receptacles being arranged in at least a first columns and a second column, each column having a plurality of coin receptacles, the method further comprising:

channeling coins from at least one of the plurality of intermediate coin receptacles to a first distribution manifold;

distributing coins with the fist distribution manifold between the first column and the second columns of coin receptacles;

channeling coins from the first distribution manifold to a second distribution manifold;

distributing the coins with the second distribution manifold to the coin receptacles within the first column of coin receptacles.

66. The method of claim 65 wherein distributing coins with the first distribution manifold further comprises rotating a pivotal coin chute.

67. The method of claim 65 wherein distributing coins with the second distribution manifold further comprises individually moving a plurality of gates between an open position and a closed position.

68. The method of claim 65 wherein distributing coins with the second distribution manifold further comprises counting the number of coins distributed into the coin receptacles within one of the two columns.

69. A method of processing coins with a currency processing machine, the method comprising:

receiving coins of mixed denominations with a hopper;

sorting coins received with the hopper into individual coin denominations with a coin processing unit;

determining the aggregate value of the coins received with the hopper with a coin processing unit;

directing the each individual coin denomination to one of a plurality of intermediate coin receptacles, each of the intermediate coin receptacles corresponding to an individual coin denomination;

selectively discharging the coins from each of the intermediate coin receptacles; and counting the number of coins discharged from each intermediate coin receptacle.

70. The method of claim 69 further comprising:

transporting coins discharged from each of the plurality of intermediate coin receptacles to a coin dispensing module with a first coin convey path; and transporting coins discharged from each of the plurality of intermediate coin receptacles to a coin spout with a second coin convey path.

71. A currency processing machine in which a user deposits funds including currency bills and coins of a plurality of denominations, the currency processing machine comprising:

means for receiving and counting the currency bills;

a plurality of coin receptacles for holding coins, a first set of the plurality of coin receptacles being associated with a first coin denomination, a second set of the plurality of coin receptacles being associated a second coin denomination;

an input hopper being adapted to receive the coins of a plurality of denominations;

a sorting device coupled to the input hopper, the sorting device being adapted to sort the coins into denominations and to discharge coins out of a plurality of exit channels, each exit channel corresponding to one of the plurality of coin denominations;

at least one rotating distribution manifold coupled to the exit channels for selectively distributing the sorted coins between the first set of the plurality of coin receptacles and the second set of the plurality of coin receptacles; and a plurality of linear distribution manifolds, at least one of the plurality of linear distribution manifolds being coupled to the at least one rotating distribution manifolds, the at least one linear coin distribution manifold being disposed above and being adapted to selectively distribute sorted coins to coin receptacles within the first set.

72. The currency processing machine of claim 71 wherein the at least one rotating distribution manifold contains a pivotal coin chute.

73. The currency processing machine of claim 72 wherein the at least one rotating distribution manifold is a generally hollow cylinder having a top surface and a bottom surface, the rotating distribution manifold having an inlet disposed in the upper surface and a plurality of outlets disposed generally towards an outer periphery of the lower surface, the pivotal coin chute being adapted to receive the coins from the inlet and to selectively distribute the coins, under the force of gravity, to one of the plurality of outlets.

74. The currency processing machine of claim 73 further comprising a controller being adapted to pivot the pivotal coin chute among the plurality of outlets.

75. The currency processing machine of claim 71 wherein each of the plurality of linear distribution manifolds includes a plurality of gates, each of the plurality of gates being adapted to direct coins to a corresponding one of the plurality of coin receptacles.

76. The currency processing machine of claim 71 wherein each of the linear distribution manifolds includes an inlet, a plurality of outlets, and a plurality of gates being movable between an open position and a closed positioned, each of the plurality of gates in the open position being adapted to direct coins through a downwardly adjacent outlet to a corresponding one of the plurality of coin receptacles.

77. The currency processing machine of claim 76 wherein each of the linear distribution mechanisms further comprising:

a sensor being adapted to count the number of coins directed to each of the outlets, the sensor being adapted to produce a signal when a predetermined number of coins have been directed to one of the plurality of outlets; and a controller being adapted to receive the signal from the sensor, the controller being adapted to individually move each of the plurality of gates from the closed to the open position upon receipt of the signal.

78. The currency processing machine of claim 71 wherein the first set of the plurality of coin receptacles are disposed within a column of coin receptacles.

79. The currency processing machine of claim 71 wherein the second set of the plurality of coin receptacles are disposed with a column of coin receptacles.

80. The currency processing machine of claim 79 wherein the column of coin receptacles has a plurality of rollers attached thereto.

81. The currency processing machine of claim 71 wherein each of the plurality of linear distribution mechanisms include a pivotal coin chute.

82. The currency processing machine of claim 71 wherein each of the plurality of linear distribution mechanisms include a movable belt directing coins to a cart, the cart being adapted to one of the plurality of coin receptacles.

83. The currency processing machine of claim 71 wherein each of the plurality of linear distribution mechanisms include a movable ramp directing coins to a cart, the cart being adapted to direct coins to one of the plurality of coin receptacles.

84. The currency processing machine of claim 71 wherein the plurality of exit channels includes at least four exit channels.

85. The currency processing machine of claim 71 wherein the plurality of exit channels includes seven exit channels.

86. The currency processing machine of claims 65 wherein the each of the plurality of coin receptacles includes a coin bag holder.

87. A currency processing machine in which a user deposits funds including currency bills and coins of a plurality of denominations, the currency processing machine comprising:

a plurality of coin receptacles arranged in a plurality of groupings of coin receptacles, each of the plurality of groupings of coin receptacles being associated with one of the plurality of denominations;

a controller being adapted to assign a certain number of the plurality of coin receptacles to each of the plurality of groupings in response to user input;

a hopper being adapted to receive the coins of a plurality of denominations a coin processing unit being adapted receive coins from the hopper and to sort coins into individual coin denominations including a first coin denomination; and a coin distribution network coupled to the coin processing unit, the coin distribution network being adapted to receive coins of one of the plurality of denominations and to distribute the coins to the associated grouping of coin receptacles.

88. The currency processing machine of claim 87 further comprising a user interface being adapted to receive input from a user.

89. The currency processing machine of claim 87 wherein the associated grouping of coin receptacles include at least two sub-groupings of coin receptacles, the distribution network including at least one rotating coin distributor being adapted to selectively distribute coins between the at least two sub-groupings of coin receptacles.

90. The currency processing machine of claim 89 wherein the at least one rotating coin distributor contains a pivotal coin chute.

91. The currency processing machine of claim 89 wherein the coin distribution network further comprises a plurality of linear distribution manifolds, at least one linear distribution manifolds being coupled to the at least one rotating coin distributor, the at least one linear coin distribution manifold being disposed above one of the at least two sub-groupings, the linear distribution manifold being adapted to selectively distribute sorted coins into the individual coin receptacles within the sub-grouping of the associated grouping of coin receptacles disposed below the linear distribution manifold.

92. The currency processing machine of claim 91 wherein each of the plurality of linear distribution manifolds includes a plurality of gates, each of the plurality of gates being adapted to direct coins to a corresponding one of the plurality of coin receptacles.

93. The currency processing machine of claim 91 wherein each of the plurality of linear distribution mechanisms include a pivotal coin chute.

94. The currency processing machine of claim 91 wherein each of the plurality of linear distribution mechanisms include a movable belt directing coins to a cart, the cart being adapted to one of the plurality of coin receptacles.

95. The currency processing machine of claim 91 wherein each of the plurality of linear distribution mechanisms include a movable ramp directing coins to a cart, the cart being adapted to direct coins to one of the plurality of coin receptacles.

96. The currency processing machine of claim 87 wherein the each of the plurality of coin receptacles includes a coin bag holder.

97. A currency processing machine in which a user deposits funds including currency bills and coins of a plurality of denominations, the currency processing machine comprising:

a plurality of coin receptacles including at least two subsets of coin receptacles;

a controller being adapted to configure the distribution of coins between the at least two subsets according to a selected operating configuration input by a user, a first operating configuration having each subset assigned to a corresponding one of the denominations with each subset corresponding to a different denomination, a second operating configuration having at least two subsets assigned to the same denomination;

a hopper being adapted to receive the coins of a plurality of denominations, a coin processing unit being adapted receive coins from the hopper and to sort coins into individual coin denominations; and a coin distribution network receiving coins from the coin processing unit and distributing coins according to the selected coin operating configuration.

98. The currency processing machine of claim 97 further comprising a user interface being adapted to receive input from a user.

99. The currency processing machine of claim 97 wherein each subset of coin receptacles comprises a column of coin receptacles.

100. The currency processing machine of claim 97 wherein the distribution network including at least one rotating coin distributor being adapted to selectively distribute coins between the at least two subsets.

101. The currency processing machine of claim 100 wherein the at least one rotating coin distributor contains a pivotal coin chute.

102. The currency processing machine of claim 100 wherein the coin distribution network further comprises a plurality of linear distribution manifolds, at least one linear distribution manifold being coupled to the at least one rotating coin distributor, the at least one linear coin distribution manifold being disposed above one of the subsets, the linear distribution manifold being adapted to selectively distribute sorted coins into the individual coin receptacles within the subset disposed below the linear distribution manifold.

103. The currency processing machine of claim 102 wherein each of the plurality of linear distribution manifolds includes a plurality of gates, each of the plurality of gates being adapted to direct coins to a corresponding one of the plurality of coin receptacles.

104. The currency processing machine of claim 102 wherein each of the plurality of linear distribution mechanisms include a pivotal coin chute.

105. The currency processing machine of claim 102 wherein each of the plurality of linear distribution mechanisms include a movable belt directing coins to a cart, the cart being adapted to one of the plurality of coin receptacles.

106. The currency processing machine of claim 102 wherein each of the plurality of linear distribution mechanisms include a movable ramp directing coins to a cart, the cart being adapted to direct coins to one of the plurality of coin receptacles.

107. The currency processing machine of claim 97 wherein the each of the plurality of coin receptacles includes a coin bag holder.

108. A currency processing machine in which a user deposits funds including coins of mixed denominations and paper notes, comprising:

means for receiving and counting the paper notes;

a hopper for receiving the mixed coins of a of a plurality of denominations;

a sorting device for sorting the mixed coins into denominations;

a plurality of coin receptacle stations for receiving the sorted coins, each of the plurality of coin receptacle stations being associated with a particular coin denomination, each coin receptacle station including a plurality of coin receptacles for holding the sorted coins and a coin distribution mechanism for selectively distributing a predetermined number of coins into each of the plurality of coin receptacles in response to an external signal from a host system, the coin distribution mechanism being adapted to terminate distributing coins to one of the plurality of coin receptacles in a coin receptacle station after a predetermined number of coins of the associated denomination have been distributed to that coin receptacle; and means for determining the amount of the deposited funds.

109. The currency processing machine of claim 108 wherein the coin receptacles of the coin receptacle station are disposed in a plurality of columns, each column having a plurality of rows.

110. The currency processing machine of claim 109 wherein the coin distribution mechanism includes a plurality of rotating distribution manifolds coupled to the sorting device for selectively distributing the sorted coins to at least one of the plurality of columns of coin receptacles.

111. The currency processing machine of claim 110 wherein each of the plurality of rotating distribution manifolds contains a pivotal coin chute.

112. The currency processing machine of claim 110 wherein the coin distribution mechanism further includes a plurality of linear distribution manifolds, at least one of the plurality of linear distribution manifolds being coupled to one of the plurality of the rotating distribution manifolds.

113. The currency processing machine of claim 112 wherein each of the plurality of linear distribution manifolds includes a plurality of gates, each of the plurality of gates being adapted to direct coins to a corresponding one of the plurality of coin receptacles.

114. The currency processing machine of claim 112 wherein at least one linear distribution manifold is disposed above each column of coin receptacles, each linear distribution manifold being adapted to selectively distribute sorted coins into one of the plurality of coin receptacles disposed below the respective linear distribution manifold.

115. A method of processing coins with a currency processing machine having a plurality of coin receptacles for holding coins, a first set of the plurality of coin receptacles being associated with a first coin denomination, a second set of the plurality of coin receptacles being associated with a second denomination, the method comprising:

receiving coins of mixed denominations with a hopper;

sorting the coins of mixed denominations into individual denominations with a coin processing module;

discharging the individual coin denominations from the coin processing module though a plurality of exit channels, each of plurality of exit channels corresponding to an individual coin denomination;

channeling coins from at least one exit channel to a first distribution manifold;

distributing coins with the first distribution manifold between the first set of the plurality of coin receptacles and the second set of the plurality of coin receptacles;

channeling coins from the first distribution manifold to a second distribution manifold;

distributing the coins with the second distribution manifold to the coin receptacles within the first set of the plurality of coin receptacles.

116. The method of claim 115 wherein distributing coins with the first distribution manifold further comprises rotating a pivotal coin chute.

117. The method of claim 115 wherein distributing coins with the second distribution manifold further comprises individually moving a plurality of gates between an open position and a closed position.

118. The method of claim 115 further comprising arranging the first set of the plurality of coin receptacles in a column.

119. The method of claim 115 further comprising arranging the second set of the plurality of coin receptacles in a column.

120. The method of claim 115 wherein distributing coins with the second distribution manifold further comprises counting the number of coins distributed into the coin receptacles of the first set.

* * * * *

UNITED STATES PATENT AND TRADEMARK OFFICE

CERTIFICATE OF CORRECTION

PATENT NO. : 6,318,537 B1
DATED : November 20, 2001
INVENTOR(S) : John E. Jones et al.

It is certified that error appears in the above-identified patent and that said Letters Patent is hereby corrected as shown below:

Title page,
Item [56] OTHER PUBLICATIONS,
(ref. C37), (Cummins), delete "Procesing" and insert -- Processing --
(ref. C64), (ASCOM), delete "idean" and insert -- idea --
(ref. A01), (Richard Haycock), insert -- With Richard Haycock; pages 1-5; dated; estimated 1994. --

Column 27,
Line 37, delete "columns" and insert -- column --
Line 43, delete "fist" and insert -- first --

Column 29,
Line 44, delete "claims" and insert -- claim --

Signed and Sealed this

Twenty-first Day of May, 2002

*Attest:*

*Attesting Officer*

JAMES E. ROGAN
*Director of the United States Patent and Trademark Office*